United States Patent [19]

Schmitz et al.

[11] 3,990,075

[45] Nov. 2, 1976

[54] SOLID STATE SECURITY SYSTEM

[75] Inventors: Lawrence S. Schmitz, Pittsburgh; Warren D. Drumheller, Murrysville, both of Pa.

[73] Assignee: Westinghouse Electric Corporation, Pittsburgh, Pa.

[22] Filed: May 29, 1975

[21] Appl. No.: 581,619

[52] U.S. Cl. ..... 340/420; 340/226; 340/276; 340/384 E; 340/416

[51] Int. Cl.[2] ..... G08B 19/00; G08B 25/00

[58] Field of Search ..... 340/420, 416, 410, 414, 340/226, 213 R, 253 C, 384 E, 409, 312, 279, 276

[56] References Cited

UNITED STATES PATENTS

| | | | |
|---|---|---|---|
| 3,188,392 | 6/1965 | Ferrell | 340/213 R |
| 3,510,863 | 5/1970 | McBrian | 340/276 |
| 3,582,949 | 6/1971 | Forst | 340/410 |
| 3,594,788 | 7/1971 | Seelig | 340/410 |
| 3,641,570 | 2/1972 | Thompson | 340/409 |
| 3,678,509 | 7/1972 | Carlo et al. | 340/420 |
| 3,699,569 | 10/1972 | Lee | 340/420 |
| 3,750,131 | 7/1973 | Fletcher et al. | 340/279 |
| 3,803,568 | 4/1974 | Higashide | 340/213 R |
| 3,818,433 | 6/1974 | Okamoto et al. | 340/410 |

*Primary Examiner*—Glen R. Swann, III
*Attorney, Agent, or Firm*—M. P. Lynch

[57] ABSTRACT

A solid state security system employing a single "chip" integrated circuit as the primary electronics located within a compact security console to provide electronic interface with one or more remote monitoring channels including a telephone dialer channel, an annunciator display, a multiplex channel suitable for processing alarm signals from a plurality of security consoles, and an intercom system suitable for providing two-way verbal communication between one or more security consoles and a central control access location.

6 Claims, 37 Drawing Figures

| $A_I$ | $B_I$ | $C_I$ | TRBI | INT |
|---|---|---|---|---|
| 0 | 0 | 0 | 0 | 0 |
| 0 | 0 | 1 | 1 | 0 |
| 0 | 1 | 0 | 1 | 0 |
| 0 | 1 | 1 | 0 | 1 |
| 1 | 0 | 0 | 0 | 1 |
| 1 | 0 | 1 | 1 | 0 |
| 1 | 1 | 0 | 1 | 0 |
| 1 | 1 | 1 | 1 | 0 |

| $A_F$ | $B_F$ | $C_F$ | TRBF | FCN |
|---|---|---|---|---|
| 0 | 0 | 0 | 0 | 0 |
| 0 | 0 | 1 | 1 | 0 |
| 0 | 1 | 0 | 1 | 0 |
| 0 | 1 | 1 | 0 | 1 |
| 1 | 0 | 0 | 0 | 1 |
| 1 | 0 | 1 | 1 | 0 |
| 1 | 1 | 0 | 1 | 0 |
| 1 | 1 | 1 | 1 | 0 |

BRG
C15
BURG
BT
C14
S
Q
CLK
R
D
S2
C12
C11
C10
C8
C9
S1
C13
C28
C27
TIO
C7
TAMP
C5
C6
TD1
C3
C4
C25
C26
C24
TOA
TOB
4029
C23
C22
C21
C20
C2
C1
PINT
TD2
701
CL2
ARMQ
ARMQ
C35
C34
C33
C32
INT
C31
RBURG
ARM
C30
C29
TPM
C19
RESM
C18
C17
PAD
C16
C0
INT

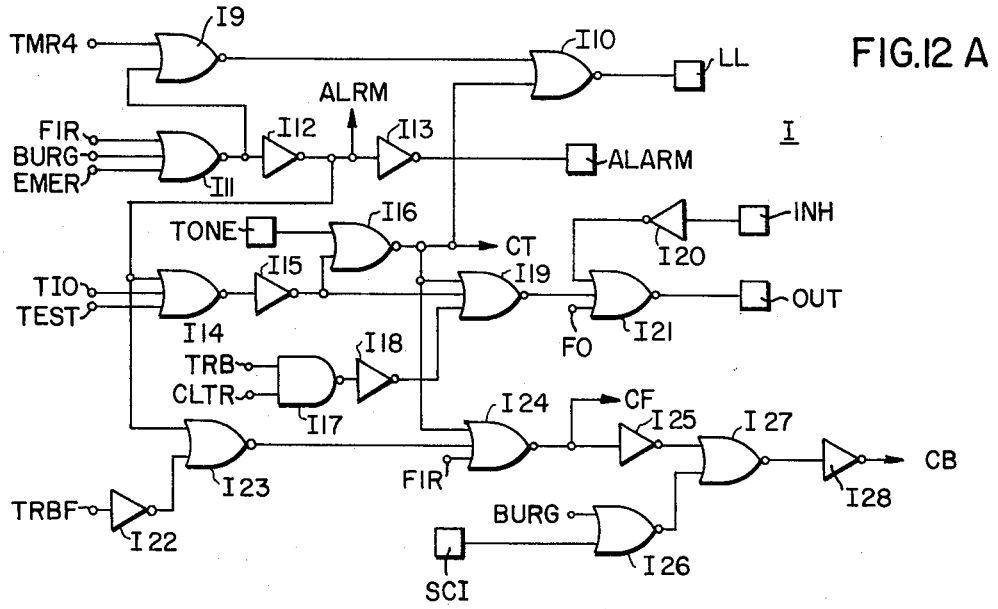
FIG.12 A
FIG.12B
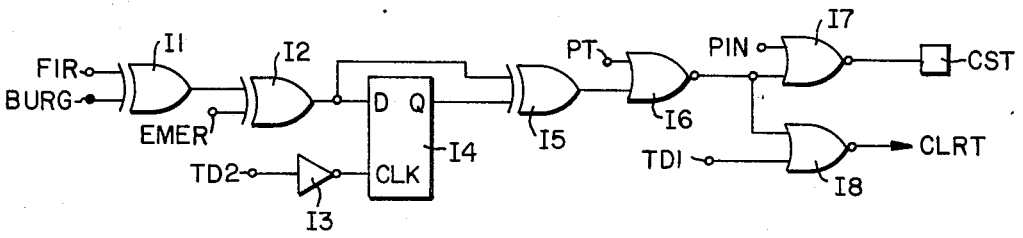
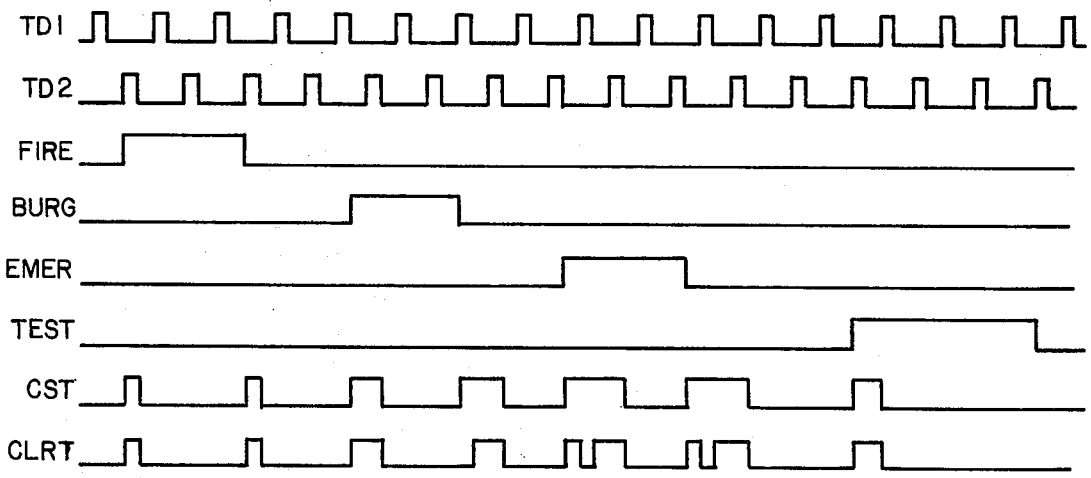
FIG.12C

J
J1
(4029)
J2
J3
J4
J5
J6
J7
CLIOOK
J8
J9
J10
J11
CT
J12
J13
J14
J15
J16
CF
J17
J18
J19
J20
J21
J22
J23
J24
J25
J26
J27
J28
J29
J30
J31
(4024)
J32
J33
(4029)
J34
(4029)
J35
J36
TPM
J37
TM
TCL
J38
J39
CL1
CL2
CL4
TRCL
J40
J41
J42
FO
PINT
CLRT
RP
CB
TD2
TD1
TM
CL1
CL2
CL4
TRCL

SOLID STATE SECURITY SYSTEM

The primary electronics functions as a central processing circuit between external security sensors and the remote monitoring channels by: (a) controlling the time period for verbal communications between a local console and remote monitoring center in accordance with alarm conditions, (b) developing digitally modulated, frequency modulated digital audio waveforms uniquely indicative of the alarm conditions manifested by the external security sensors as well as unique digital audio waveforms indicative of circuit failures associated with said external security sensors, (c) providing adjustable time-in, time-out arm/disarm capability for intrusion security sensors as well as circuit test and reset functions.

CROSS REFERENCE TO RELATED CO-FILED CO-PENDING PATENT APPLICATIONS

1. "A Solid State Security System", Ser. No. 582,553, filed May 29, 1975 by L. S. Schmitz;
2. "Noise Generator Circuit For A Security System", Ser. No. 582,552, filed May 29, 1975, by L. S. Schmitz;
3. "Trouble Indicator Circuit For A Security System", Ser. No. 582,551, filed May 29, 1975, by L. S. Schmitz;
4. "Reset Circuit For A Security System", Ser. No. 582,012, filed May 29, 1975, by L. S. Schmitz; and
5. "Automatic Test Sequence Circuit For A Security System", Ser. No. 582,011, filed May 29, 1975, by L. S. Schmitz.

All of the above co-pending applications have been assigned to the assignee of the present invention.

While the claimed subject matter of the cross-reference related application identified as Item 1 above recites the novel structure and function of the primary electronics disclosed herein as a central processing circuit for a solid state security system, the claimed subject matter of the subject application is directed to the combination of the primary electronics with local and remote alarm processing and indicating circuitry as well as external security sensors forming a novel solid state security system.

BACKGROUND OF THE INVENTION

The electronic security business has undergone a significant growth in recent years with requirements ranging from a simple trip switch for activating an audible alarm to sophisticated computer based security systems for providing total security for nuclear installations. To date, numerous discrete circuits for alarm and control purposes have been packaged in large consoles to provide the total security requirements of modern facilities. The cost and complexity of utilizing numerous discrete circuits and the need for packaging the various circuit functions into an integral system has failed to satisfy the demand for relatively simple, compact and inexpensive security systems suitable for installation in both residential as well as government and industrial applications. Also lacking in many of the conventional security systems is the capability to satisfy national and local building codes such as NFPA as well as Underwriters Laboratory (UL) criteria.

SUMMARY OF THE INVENTION

There is described herein with reference to the accompanying drawings a security system concept suitable for responding to remote and locally initiated alarm conditions to initiate local audible and voice communication features as well as initiate automatic communications with remote communications centers such that the alarm condition is clearly identified and communicated to assure an appropriate and timely response.

The primary electronics of the security systems is in the form of a "one chip" integrated semiconductor package occupying a space of approximately 100 mils by 150 mils. The chip is mounted in a master control console of about 13 × 8 × 2 inches. The "one chip" integrated semiconductor circuit, which is located on a printed circuit board, includes logic circuitry for interrogating the in-coming alarm signals to determine their validity, initiating audible local recognition of the alarm condition and provide digital data and control signals for communications with remote monitoring channels. The integrated semiconductor circuit includes logic circuitry to detect circuit component failure and unauthorized tampering as well as logic circuitry to reset and automatically test the circuits of the system.

The one chip primary electronics of the solid state security system disclosed herein is designed to provide all the necessary functions for a low cost U.L. listed combination fire and burglary alarm system capable of generating output signals that communicate alarm conditions by way of a digital dialer, a hardwired annunciator, a multiplex communications system, and/or an intercom system.

The primary electronics perform the following essential functions for a three alarm security system, wherein the three alarm conditions monitored include fire, intrusion (burglary) and emergency:

1. supervision of the intrusion loop to provide both visual and audible indication of abnormal conditions as well as an indication of tampering;
2. programmable exit and entry times, or time-in and time-out, of 0, 10, 20, and 30 seconds to permit authorized exit and entry without initiating an intrusion alarm;
3. supervision of the fire sensors and audible indication of a fire alarm condition;
4. latching valid input alarm signals to assure proper response;
5. system resetting operating as follows:

a. providing a power ON master reset (RSM) input signal which clears all latches and resets all system timing conditions;

b. providing a manual reset (RTC), in response to actuation of code lock buttons or a key lock on the master control console, for resetting alarm conditions and for arming and disarming the intrusion sensor circuits in combination with the time-in and time-out periods;

c. providing an automatic reset of the fire and emergency alarm circuitry four minutes after detection of the alarm condition if the alarm conditions have been cleared. In the event of an intrusion condition, the intrusion circuitry will be reset once the condition has been cleared and the time-out sequence will be initiated immediately following reset of the intrusion latch after which time the system will be again armed;

d. providing reset signals for the latch circuits associated with the test sequence circuitry after the four minute time interval, or after the test sequence is complete;

6. providing an automatic test sequence to determine the operational integrity of fire, tamper and emergency circuitry external to the "chip" and developing an audible, visual and digital indication of the results of the test sequence;

7. providing an audible, visual and digital indication of component failure in the sensor circuits which provide input signals to the chip;

8. providing digital outputs to identify the state of the alarm system and to individually identify the various alarm conditions;

9. providing a noise generator circuit on the chip which generates frequency modulated digital waveforms which are audio amplified to produce distinctive noises for the various conditions in the following order of priority; fire, intrusion/tamper, emergency, test, time-in/time-out, tone, fire trouble and intrusion trouble. The noise generator circuit further functions to develop all timing signals for the large-scale integrated circuit; and 10. providing an on chip clock oscillator circuit for generating the basic system clock signal of 97.28 KHz which is supplied to the noise generator circuit.

The system disclosed herein satisfies the appropriate requirements of UL standards 985 and 1023 as well as NFPA standard 74.

BRIEF DESCRIPTION OF THE DRAWINGS

The invention will become more readily apparent from the following exemplary description in connection with the accompanying drawings:

FIG. 9A is a schematic illustration of an arm/disarm reset logic and timer circuit for use in FIG. 3.

FIGS. 12A and 12B are schematic illustrations of circuitry comprising an alarm priority logic circuit for use in FIG. 3, and FIG. 12C is a pulse graph illustrating the operation of the circuit of FIG. 12B;

DESCRIPTION OF THE PREFERRED EMBODIMENT

Figure 1:
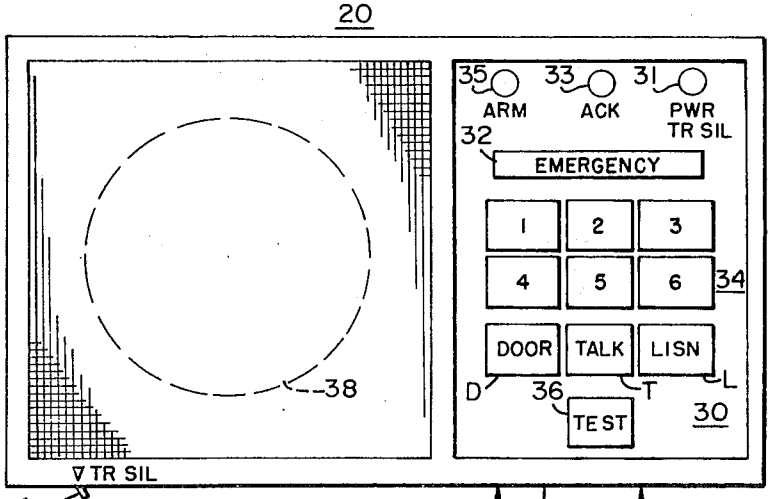
FIG. 1 is a schematic illustration of a master control console and associated circuitry of a solid state security system.
Figure 1:
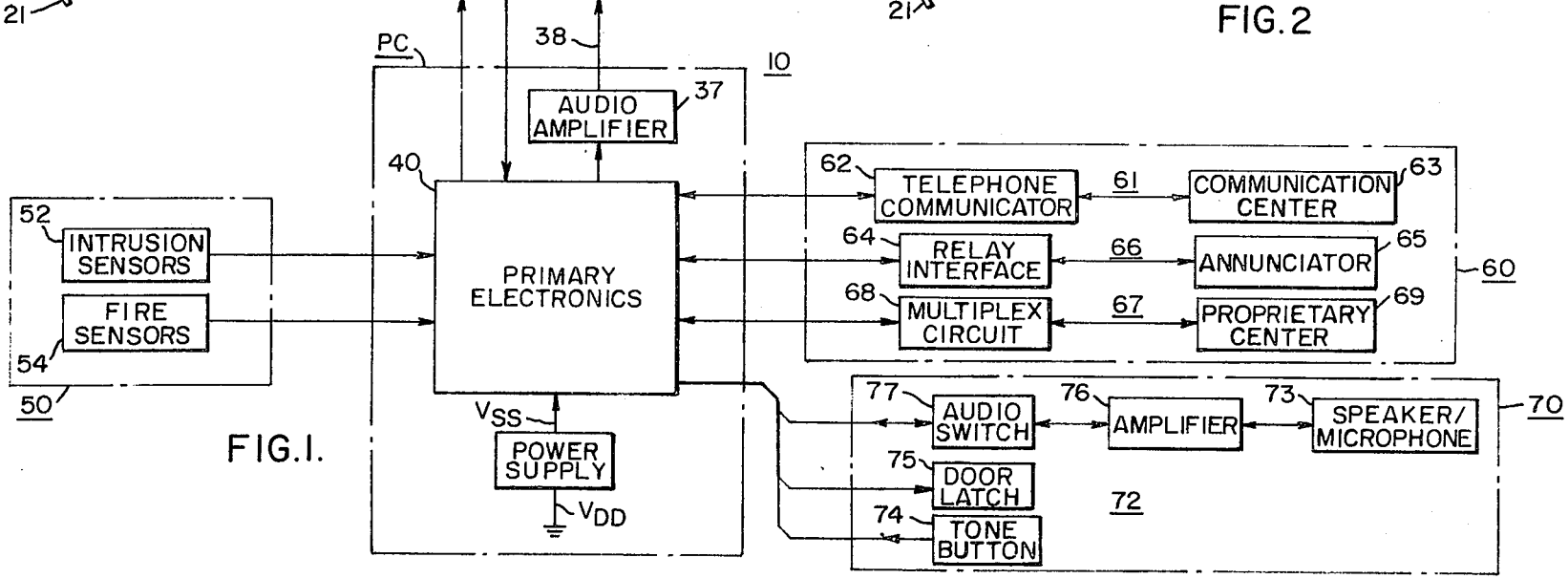

Referring to FIG. 1 there is illustrated in block diagram form a security system 10 including a master control console 20 depicted as including an exterior control panel 30 and an internally mounted printed circuit board PC including primary electronics 40. The primary electronics 40 are electrically connected to receive input signals from the local actuators consisting of emergency button 32, the code lock buttons 34, and the test button 36 which are located on the control panel 30 as well as input signals from remote sensors 50, herein represented as fire sensors 52 and intrusion sensors 54. The fire sensors 52 can be typically implemented through the use of heat and smoke detecting devices, whereas the intrusion sensors 54 could include perimeter intrusion systems, pressure mats, trip devices for monitoring movement of windows and doors, etc. Wireless RF devices, such as those disclosed in U.S. Pat. Nos. 3,772,669, 3,781,836, 3,796,958, and 3,796,959, assigned to the assignee of the present invention, are also appropriate devices for transmitting input information to the primary electronics 40.

The primary electronics 40 interrogates the input signals provided by both the local and remote actuating devices and after determining the validity of the input information, initiates a local audible alarm which is indicative of the type of alarm condition, and transmits a digital signal indicative of the alarm condition to one or more remote monitoring channels 60.

There are numerous appropriate schemes for implementing the remote monitoring channels 60 including those illustrated in FIG. 1. A technique currently in use in security systems is represented by the remote monitoring channel 61 wherein the digital output signals from the primary electronics 40 activate a telephone dialer circuit 62 to cause a message particularly identifying the type of alarm condition to be transmitted to a remote communication center 63. A typical telephone communications system is described in detail in U.S. Pat. No. 3,601,540 entitled "Security System" issued Aug. 24, 1971, assigned to the assignee of the present invention and incorporated herein by reference. Typically the communication center 63 is manned by personnel who will respond to the transmitted alarm condition by transmitting an acknowledge signal to the console 20 and initiating contact with an appropriate service group, such as a police department, fire department, hospital, etc. An additional "talk-in" communication feature includes the use of the speaker 38 located within the master control console 20 to provide verbal communication for a limited period of time between an individual located at the master control console and personnel located at the communication center 63.

A second remote monitoring channel is provided by the relay interface 64 and annunciator 65 which constitute channel 66. The digital output signals from the primary electronics 40 function to activate appropriate relays in the relay interface 64 which in turn results in activation of an audio and/or visual segment of annunciator 65 to identify the type and location of an alarm condition.

Remote monitoring channel 67, which includes a multiplexing circuit 68 and a proprietary center 69, is of particular value when numerous master control consoles are interconnected in a single system, such as would be used in an apartment complex. In such a system the individual master control consoles would be located within each apartment unit. The multiplexing circuit would sequentially process the digital signals from the various master control consoles for presentation at a proprietary center, i.e., a guardhouse or control security room.

The intercom/access channel 70 represents another useful communications link between the master control console 20 and a remote entry location 72 such as the main entrance of an apartment building. The remote entry location 72 is illustrated as including a speaker/microphone 73, a tone button 74, a door latch mechanism 75, audio amplifier 76 and audio switch 77. The operation of the intercom/access channel 70 is controlled at the master control console 20 by talk button T, listen button L and door latch button D. While the embodiment of FIG. 1 illustrates one intercom/access channel by way of example, it is apparent that additional channels could be added to serve additional master control consoles located in each of a plurality of apartment units.

The actuation of tone button 74 by an individual desiring access to the apartment building causes a TONE signal in the primary electronics to produce an audio signal which is supplied to the speaker 38. The apartment occupant at the master control console 20 can actuate talk button T and verbally request identification of the individual by verbal communication through speaker 38, audio switch 77, amplifier 76 and speaker/microphone 73. The occupant may then actuate listen button L to permit verbal communication by the individual from speaker/microphone 73 to speaker 38. If the occupant then wishes to give the individual access to the building the occupant actuates door latch button D which releases the building door latch 75.

In the event of an alarm or test condition the intercom function is immediately aborted by the application of an ALARM or TST signal from the primary electronics 40 to the audio switch 77. The audio switch may be a simple relay circuit and the ALARM or TST signals operate to open the circuit between the master control console 20 and the remote entry location 72.

While the remote sensors 50 are designed to respond to the presence of predetermined alarm conditions, the emergency button 32, located on the control panel 30, permits an individual to initiate communication of an alarm condition not particularly monitored by the remote sensors 50. Such an emergency condition could be a call for medical help. While the digital alarm output signal developed by the primary electronics 40 in response to an actuation of button 32 will not clearly identify the type of alarm, the availability of a talk-in feature, whereby the individual is given an opportunity to verbally communicate with the communication center, permits identification of the nature of the emergency.

The operational status of the security system 10 is displayed by the individual light emitting diodes (LED) located on the control panel 30 of the master control console 20. The presence of power for the security system is suitably provided by indicator light 31. The reception of the transmitted alarm condition by the communication center 63 is acknowledged by the communication center 63 by illuminating the acknowledge indicator light 33. Light 35 indicates the arm/disarm condition of the intrusion sensors 52 of the security system 10.

The arming and disarming of the security system 10 is limited to the intrusion function and is controlled by the code lock buttons 34. The security system is designed to respond to a particular sequential entry of code information corresponding to the sequential actuation of the code lock buttons 34. Assuming, for the purposes of discussion, that an individual wishes to arm the intrusion sensors 52 of the security system 10 prior to leaving the secured premises. The individual will enter the designated code for his system by the actuation of the appropriate code lock buttons 34. The system is designed to arm, or become responsive to the intrusion sensors 52, following the expiration of a time duration (time-out) sufficient to permit the individual to leave the premises. Likewise, upon return to the premises and following entry, the individual is alloted a limited period of time (time-in) to enter the appropriate code in order to disarm the intrusion sensors 52. The circuits associated with the fire sensors 54 and the emergency button 32 are always armed. The test button 36 is disabled by an alarm or armed condition. An implementation of the operation of the code lock buttons 34 is described in detail in U.S. Pat. No. 3,846,756, entitled "Programmable Sequential Logic Circuit", issued Nov. 5, 1974, assigned to the assignee of the present invention and incorporated herein by reference.

Figure 2:
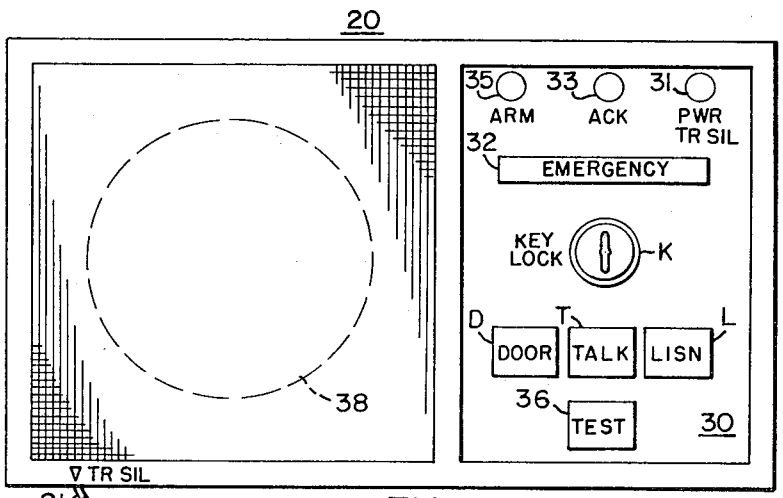
FIG. 2 is an alternate embodiment of the master control console of FIG. 1.

While the master control console 20 of FIG. 1 depicts the use of code lock buttons 34 for resetting the security system 10 as well as for arming and disarming the intrusion sensors 52, the code lock buttons 34 may be replaced by a simple key lock mechanism K as illustrated in FIG. 2.

The test button 36 located on the control panel 30 provides an individual with the opportunity to randomly check the operational integrity of the security system 10. The actuation of the test button 36 causes test signals to be sequentially applied to the input circuits of the primary electronics 40 to determine the integrity of the security system 10. The status of the security system is acknowledged by a local audible alarm circuit as well as by a remote monitoring channel.

Figure 3:
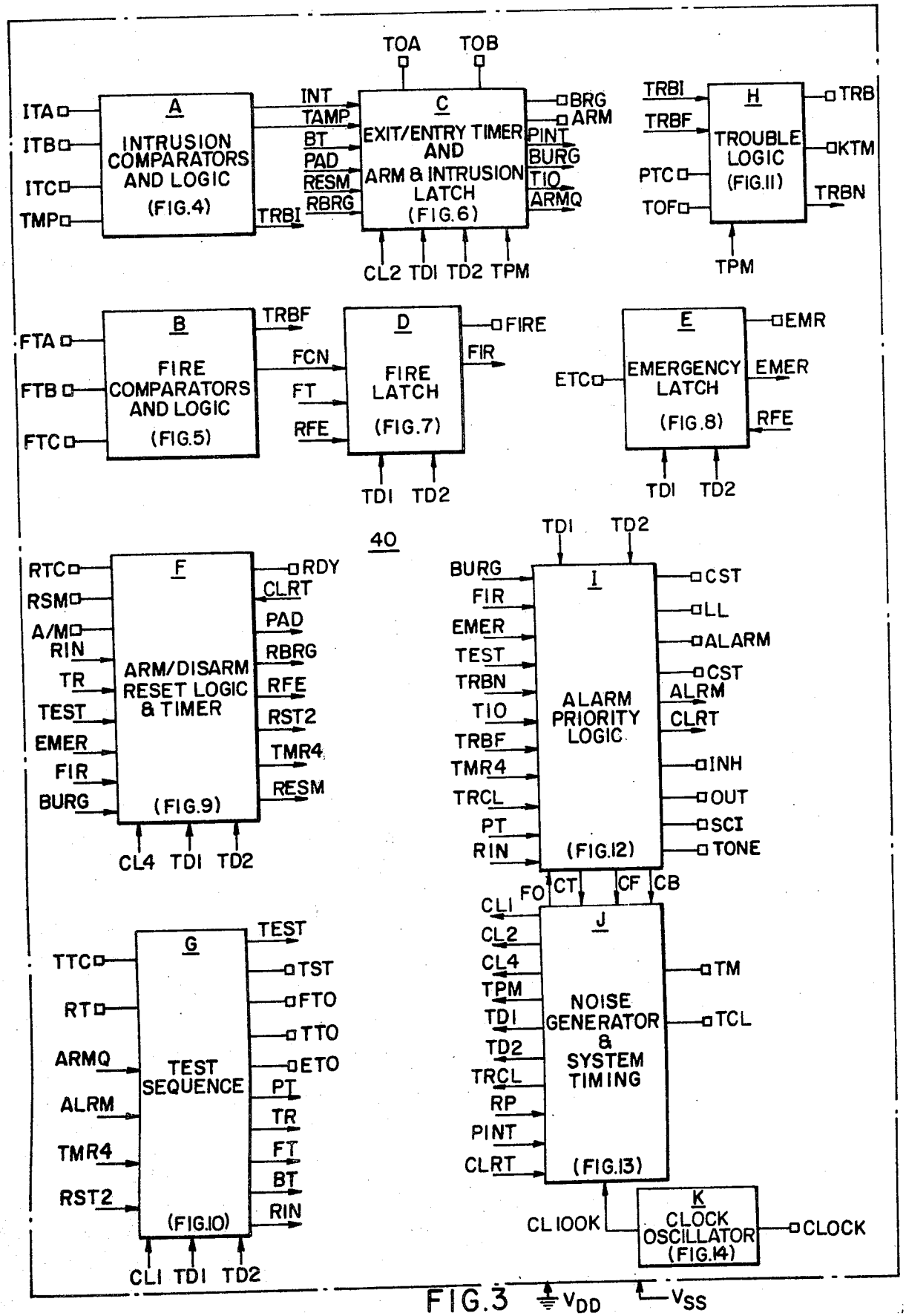
FIG. 3 is a block diagram illustration of the primary electronics of the embodiment of FIG. 1.
Figure 18A:
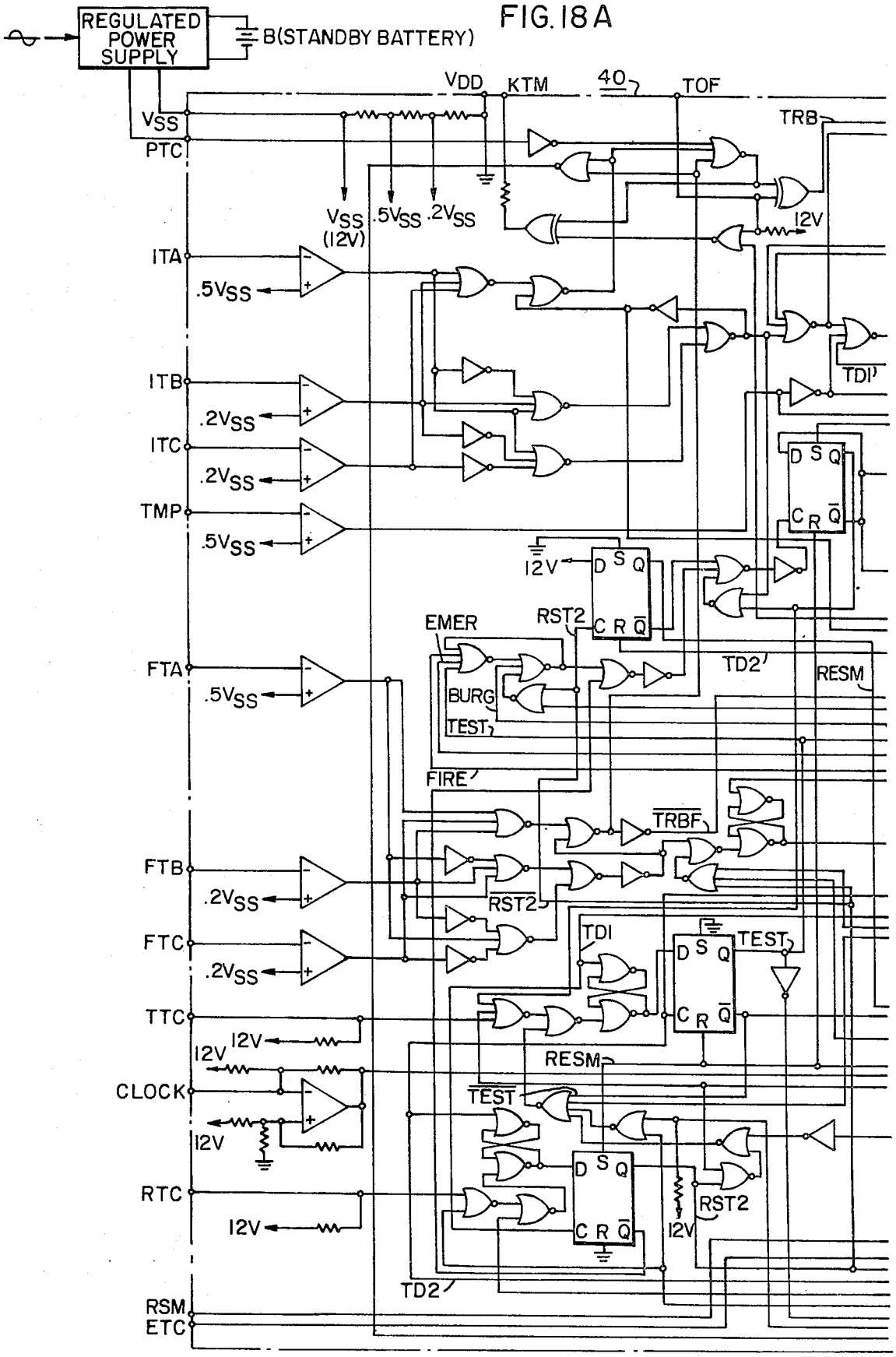
FIGS. 18A, B and C illustrate a large-scale integrated circuit layout of the primary electronics.

The one-chip semiconductor integrated circuit identified as primary electronics 40 of FIG. 1 is illustrated in functional block diagram format in FIG. 3 and in a large-scale integrated circuit layout in FIGS. 18A, B and C. Rather than complicate the understanding of the operation of block diagram of FIG. 3 by completing all the interconnections between the respective circuits, as shown in FIGS. 18A, B and C, the inputs and outputs of the various circuits have been identified with labels which can be located on the chip layout of FIGS. 18A, B and C. Inputs and outputs identified with a represent inputs generated external to the primary electronics 40 and outputs transmitted externally from the primary electronics 40. All others refer to internally generated and terminated signals.

The following tabulation sets forth a listing and definition of the external and internal signals of the circuits A–K of FIG. 3:

| EXTERNAL SIGNALS | FUNCTION |
|---|---|
| TOF | Trouble Silence Input |
| PTC | Loss of AC Power Input |
| ITA | Intrusion Sensor Input |
| ITB | Intrusion Sensor Input |
| ITC | Intrusion Sensor Input |
| FTA | Fire Sensor Input |
| FTB | Fire Sensor Input |
| FTC | Fire Sensor Input |
| TTC | Test Activate Input |
| RTC | Reset Input |
| RSM | Master Reset Input |
| ETC | Emergency Input |
| A/M | Automatic Reset Input |
| TMP | Tamper Input |
| RT | Reset Test |
| TOA | Entrance/Exit Time Delay Programming Input |
| TOB | Entrance/Exit Time Delay Programming Input |
| TONE | Tone Input |
| Clock | Clock Input |
| $V_{DD}$ | Ground |
| $V_{SS}$ | 12 Volts DC |
| INH | Inhibit Alarm Input |
| SCI | Alarm Sound Change Input |
| TCL | Test Clock Input |
| TRB | Trouble Output |
| TST | Test Output |
| ARM | Intrusion Circuit Armed Output |
| FIRE | Fire Output |
| EMG | Emergency Output |
| BRG | Intrusion Output |
| CST | Change of State Pulse |
| RDY | Ready to Talk Output |
| TM | Timing Pulse Output |
| LL | Low Level Audio Output |
| OUT | Audio Alarm Output |
| FTO | Fire Test Output |
| KTM | Trouble Flasher |
| ALARM | Alarm Output |
| ETO | Emergency Test Output |
| TTO | Tamper Test Output |

| INTERNAL SIGNALS | FUNCTION |
|---|---|
| CLIOOK | Digital Clock Signal from Clock Oscillator Circuit K - Nominally 97.28 KHz |
| TPM | Square Wave with ½ Second Period |
| CL1 | Square Wave with 1 Second Period |
| CL2 | Square Wave with 2 Second Period |
| CL4 | Square Wave with 4 Second Period |
| TRCL | Trouble Clock - ½ Second Pulse Occurring Every 4 Seconds |
| TD1 | A Clock Signal with a Nominal Pulse Width of 15.625 Milliseconds Occurring Every 62.5 Milliseconds |
| TD2 | Same as TD1 But Delayed by 31.25 Milliseconds |
| FO | A Square Wave Whose Period Changes as a Function of Time |
| CT | Control Signal for the Noise Generator and System Timing Circuit J |
| CF | Control Signal for the Noise Generator and System Timing Circuit J |
| CB | Control Signal for the Noise Generator and System Timing Circuit J |
| ALRM | FIR + BURG + EMER |
| CLRT | Pulse for Resetting Timing Circuits |
| TRBN | A Signal Enabling the Trouble Audio Alarm Output |
| TEST | Output of Latching Circuit of Circuit G |
| PT | A Pulse Indicating the Start of Test Sequence of Circuit G |
| TR | A Pulse for Automatic Reset of Test Conditions |
| FT | A One Second Test Pulse for Output Fire |
| BT | A One Second Test Pulse for Output BRG |

-continued

| | |
|---|---|
| RIN | Inhibits RTC During Test Cycle |
| EMER | Output of Latch Circuit of Circuit E |
| RFE | Reset Signal for Fire and Emergency Latch Circuits of Circuits D and E, Respectively |
| FIR | Output of the Latch Circuit of Circuit D |
| BURG | Output of Intrusion Latch Circuit of Circuit C |
| PAD | Arm/Disarm Pulse |
| RBRG | Automatic Intrusion Reset |
| RST2 | Output of RTC Flip-Flop of Circuit F |
| TMR4 | Four Minute Timer Signal |
| RESM | Internal Master Reset Signal |
| TRBF | Trouble in the Fire Loop FL |
| FCN | Fire Condition in the Fire Loop FL |
| INT | Intrusion Condition in the Intrusion Loop IL |
| TAMP | Tamper Condition in the Tamper Loop TL |
| PINT | Pulse Indicating Start of an Intrusion Condition |
| TIO | Time-In, Time-Out |
| ARMQ | Output of ARM Flip-Flop Circuit of Circuit C |

Intrusion Comparators and Logic Circuit A (FIG. 4) and Fire Comparators and Logic Circuit B (FIG. 5) analyze voltage signals developed by the remote intrusion sensors 52 of intrusion loop IL and fire sensors 54 of the fire loop FL respectively.

Circuits A and B compare the incoming voltage signals to predetermined voltage levels to distinguish between alarm and non-alarm conditions as well as providing a supervisory function by monitoring component failure or trouble conditions as well as tamper conditions. The Intrusion Comparators and Logic Circuit A transmits logic input signals indicative of intrusion alarm and tamper cond1tions to the Exit and Entry Timer/Arm and Intrusion Latch Circuit C (FIG. 6) while the Fire Comparators and Logic Circuit B transmit logic transmits input signals indicative of fire alarm conditions to Fire Latch Circuit D (FIG. 7). The latch functions of circuit C and circuit D serve to store valid alarms or tamper conditions thus avoiding untimely loss of the alarm or tamper condition. The alarm or tamper condition is maintained by the latch function of circuits C and D until the alarm condition is cleared.

Emergency Latch Circuit E (FIG. 8) similarly functions to initiate and maintain an alarm output signal in response to an actuation of the emergency button 32 of the master control console 20.

Test Sequence Logic Circuit G (FIG. 10) likewise includes a latching circuit to respond to a test input signal initiated by the actuation of test button 36 of the master control console 20. The Test Sequence Logic Circuit G responds to the actuation of the test button 36 by sequentially initiating test signals simulating alarm conditions to check the operational integrity of the security system 10. Local audible signals are generated by the Noise Generator and System Timing Circuit J (FIG. 13) to indicate the operational status of the security system 10 in response to the test signals. The latching function of the Test Sequence Logic Circuit G is rendered inoperative in the event an actual alarm condition is present or if the intrusion circuits are armed. Each latching circuit associated with fire, intrusion, emergency and test input signals as well as the reset input signal include a built-in delay whereby latching is delayed for a predetermined period of time to insure rejection of erroneous signals of a duration less than a minimum period of time, i.e. 15 milliseconds. All input signals less than this predetermined period of time will be rejected and all signals longer than a second predetermined period of time, i.e. 94 milliseconds, will be accepted as valid or true input conditions. Input signals of a duration between 15 and 94 milliseconds may or may not be accepted depending upon the relationship of the event to timing signals TD1 and TD2.

The Arm/Disarm Reset Logic and Timer Circuit F (FIG. 9) functions to transmit reset signals to the above-identified latching functions. While manual reset is provided by the actuation of code lock buttons 34 or key lock K, a slight change in the internal wiring of the console 20 can provide automatic resetting. The output signals developed by circuits C, D, E, F and G are supplied as input signals to Alarm Priority Logic Circuit I.

The Alarm Priority Logic Circuit I (FIG. 12) transmits the conditions reflected by the input signals to the Noise Generator and System Timing Circuit J on a priority basis. In all cases the fire alarm condition takes priority over all other alarm conditions with intrusion, emergency and test conditions following in order of priority.

The Noise Generator and System Timing Circuit J (FIG. 13) which is driven by the Clock Oscillator Circuit K (FIG. 14) responds to input alarm conditions by initiating frequency modulated digital audio waveform outputs from circuit I of separate and distinct character for each of the respective alarm conditions on a priority basis. A trouble condition present in the remote sensors 50 will produce an input signal to the Noise Generator and System Timing Circuit J from the Trouble Logic Circuit H (FIG. 11) which will initiate a low-level audio output from circuit I which is clearly distinguishable from the alarm audio output signals.

The Arm/Disarm Reset Logic and Timer Circuit F includes a timing circuit having both a one minute and a four minute duration. The one minute timer function is used to assure one minute of audio alarm for intrusion if the intrusion alarm has not been reset. After one minute the audio output may be inhibited. If it is not inhibited, the audio output signal will continue for an additional three minutes, or a total of four minutes, after which the system may be programmed to automatically return to an armed state by a signal transmitted to circuits C, D, E and G from the Arm/Disarm Reset Logic and Timer Circuit F if all sensors are inactive and no tamper or trouble condition is present. A "ready-to-talk" signal RDY is transmitted from the Arm/Disarm Reset Logic and Timer Circuit F to the remote monitoring channels 60 to initiate the talk-in verbal communication between the master control console 20 and the remote communication center in response to the actuation of the emergency button 32 or at the conclusion of the one minute audible alarm in the case of an intrusion alarm condition. No interruption of the alarm condition is permitted in a fire alarm condition, thus no talk-in period is provided in the case of a fire alarm condition. This is in accordance with Underwriters Laboratory (UL) requirements.

Detail schematic illustrations of typical circuits for implementing the functions identified in FIG. 3 are illustrated in FIGS. 4–14 with the large-scale integrated circuit or chip, incorporating the detail logic of FIGS. 4–14 illustrated in the layout in FIGS. 18A, B and C. The unique audio waveforms characteristic of fire, intrusion and emergency alarm conditions are graphically illustrated in FIGS. 15, 16 and 17 respectively with numerical listings of frequency versus time for the waveforms appearing in Appendices A, B and C respectively.

OPERATIONAL FUNCTIONS OF THE PRIMARY ELECTRONICS 40

Arm/Disarm

The fire sensing circuits 54 are always armed as are the emergency and tamper functions. Intrusion sensing circuits 52 may be armed and disarmed as described above through the use of the code lock buttons 34 of FIG. 1 or the key lock K of FIG. 2 in cooperation with the Arm/Disarm Reset Logic and Timer Circuit F. Code lock buttons 34 and key lock K also provide the manual reset capability.

Automatic and Manual Reset

When operating in the manual mode, all alarm conditions will remain active and a low level audible alarm will continue after the four minute audible alarm of the last occurring alarm condition. In the automatic reset mode, the audible alarm output will terminate at the end of the four minute audible alarm period associated with an alarm condition if the cause of the alarm condition has been cleared. In the case of an intrusion alarm condition, the security system 10 will return to an armed state by initiating a time-out sequence at the end of the four minute alarm period if the cause of the alarm has been cleared. The arm and reset signals are initiated by circuit F. The four minute time period will run to its conclusion before the intrusion circuit is again armed in the case of an intrusion alarm condition even if the alarm condition has been cleared prior to the expiration of the four minute period. The system will not arm if any intrusion sensor is active.

Test

The test sequence can only be initiated by the operation of test button 36 when no alarm conditions are present and the intrusion sensing circuit is not armed. Once a test has been initiated there is a nine second period when alarms and arm/disarm conditions are ignored by the primary electronics 40. After the nine second period, any alarm will immediately clear the test signal thus rendering the security system immediately responsive to the alarm condition. Approximately four minutes after the test sequence is initiated, assuming the absence of alarm conditions, the circuit F will transmit a signal to automatically reset the system 10.

Talk-in

The one minute timing function of the circuit F is used to develop ready-to-talk signal RDY to initiate the talk-in feature to provide verbal communications between an individual at the master control console 20 and the communications center 63 or the proprietary center 69 after one minute has elapsed following the initiation of an intrusion alarm condition. If the intrusion alarm condition is reset prior to the expiration of the one minute, then the talk-in capability will be present immediately upon resetting of the intrusion alarm condition. The talk-in capability always exists in an emergency alarm condition and never exists during a fire alarm condition. The talk-in capability will always exist when no alarm conditions are present. An inhibit signal INH applied to the circuit I terminates the audible alarm output from Circuit I during the designated talk-in period.

Trouble Silence

The trouble silence switch 21 permits an individual located at the master control console 20 to terminate the audible trouble signal output from circuit I.

Power Indication

Power indicator lamp 31 will be on during the presence of normal AC power condition and will be off in the absence of AC power.

Under normal AC power conditions:

If fire trouble or intrusion trouble conditions exist, then the power indicator lamp 31 will go out and an audible alarm will be initiated by circuit I in response to a signal transmitted from Trouble Logic Circuit H to Circuit I. If under these conditions, the audible trouble signal is terminated by the actuation of trouble silence switch 21, then the indicator lamp 31 will go into a flashing mode. If the trouble condition is cleared but the trouble silence switch 21 has not been reset, then the light indicator 31 will continue to flash and an audible sound is produced by circuit I to notify the individual to reset the trouble silence switch 21.

These power indication functions, which are initiated by the KTM output of the Trouble Logic Circuit H are in compliance with Underwriter Laboratory requirements.

The primary electronics 40 provide a wide variety of audible, visual and digital signals suitable for external control and indication. These signals can be classified as:

Audible Interface Signals

Output signals OUT and LL are intended to audibly identify the status of the system 10. Signal OUT provides noises to distinctively identify system status. Signal LL operates to change a loud audible alarm to a low level audible alarm after a predetermined time.

Input signal INH, as generated by a remote monitoring channel terminates the audible signals. Input signal TOF functions to silence the audible trouble signal. Input signal TONE may be used by remote monitoring channels for audible annunciation.

Visual Interface Signals

Output signals ARM and KTM control visual indicators with the signal ARM indicating the arm/disarm status of the intrusion sensors 52. Signal ARM is a logic 0 when the intrusion sensors 52 are disarmed and a logic 1 when they are armed. During time-in/time-out or when output BRG is a logic 0, the signal ARM is a 2 Hz square wave. Signal KTM indicates the status of trouble inputs PTC and TOF.

Digital Interface Signals

The following output signals of the primary electronics 40 are available to identify the alarm and system status to remote monitoring channels:

| | |
|---|---|
| FIRE | Indicates a Fire Alarm |
| BRG | Indicates an Intrusion Alarm |
| EMR | Indicates an Emergency Alarm |
| ALARM | Indicates FIRE + BRG + EMR |
| TST | Indicates a Test Sequence |
| CST | Indicates a Change of State of the System |
| RDY | Indicates to the Remote Monitoring Channels the Opportunity to use Input Signal INH |
| ARM | Indicates the Status of the Arm/Disarm Circuitry |
| TRB | Indicates Circuit Failure, or Trouble, in the Fire or Intrusion Loops |

The following input signals may be initiated by remote monitoring channels to control the system 10:

| | |
|---|---|
| INH | Inhibit Signal OUT |
| TONE | Generate a Tone on Output OUT |
| RT | Reset of Test Condition |
| RTC | Reset Arm/Disarm or Alarm Function |
| PTC | Remote Trouble Indication |
| TTC | Initiate a Test Sequence |

Described herebelow in connection with FIGS. 4–14 are circuit arrangements suitable for implementing the functions identified in FIG. 3. By way of example, the counter circuits are identified as commercially available RCA circuits and the "D" type flip-flop circuits correspond to commercially available RCA circuits CD4013.

INTRUSION COMPARATORS AND LOGIC CIRCUIT A

Figures 4A, 4B:
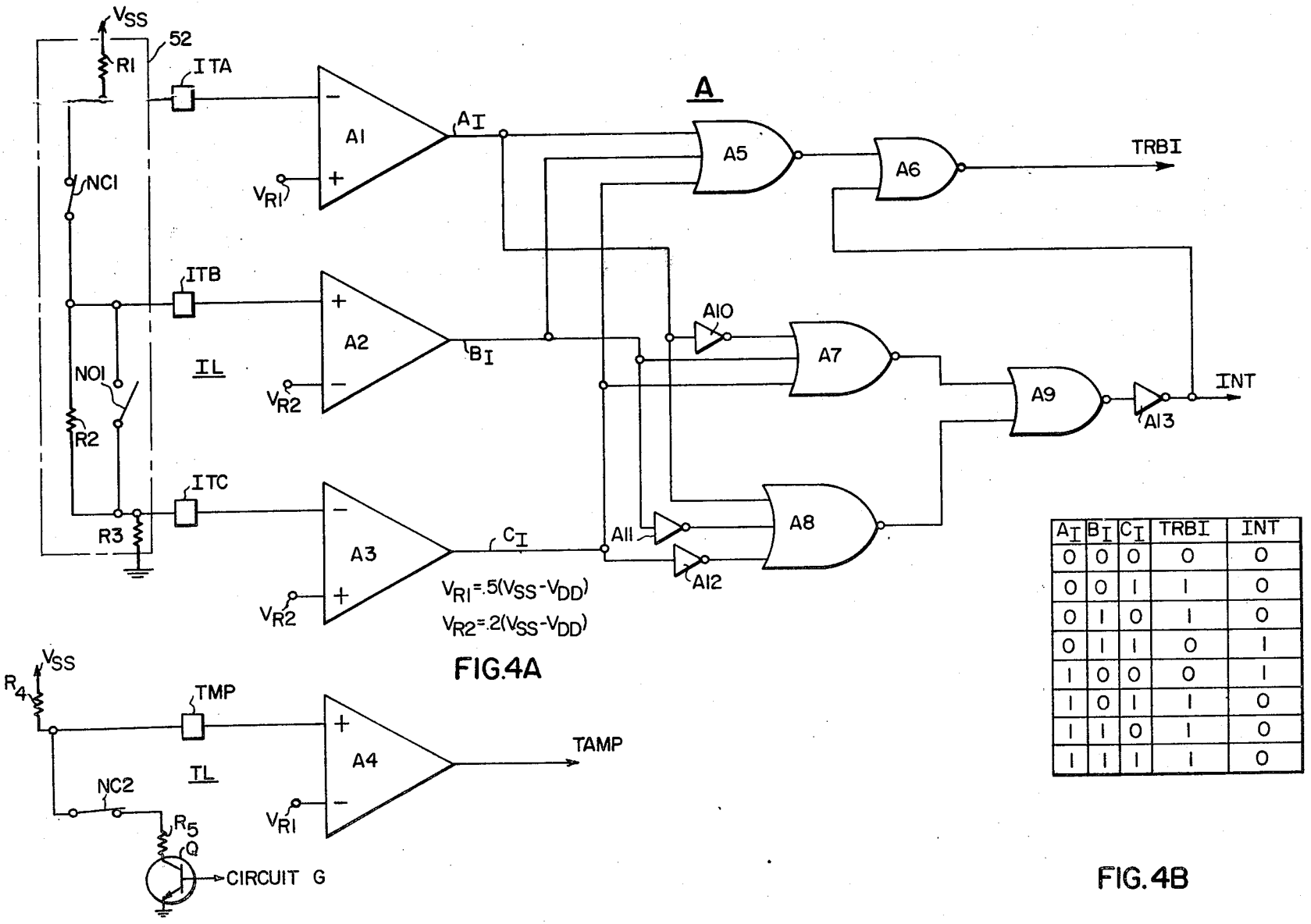
FIG. 4A is a schematic illustration of an intrusion comparator analogic circuit phrased in FIG. 3.
FIG. 4B is a truth table defining the operation of the circuit of FIG. 4A.

The purpose of circuit A, which is schematically illustrated in FIG. 4A, is to monitor analog signals produced by the states of normally open NO1 and normally closed NC1 contacts of intrusion sensor 52 in the intrusion loop IL and indicate if an intrusion condition (INT) or a trouble condition (TRBI) exists. The trouble condition corresponds to a defective component such as resistors R1 and R2 or an open or short in the circuit. Circuit A also monitors the analog signal corresponding to the condition of the normally closed contact NC2 of the tamper loop TL and supplies the tamper signal TAMP to circuit C. While only one normally closed contact is illustrated in the tamper loop TL for the sake of clarity, numerous sets of contacts could be serially connected wherein each circuit to be monitored for tampering would include a normally closed set of contacts.

Comparator circuits A1, A2, A3 and A4, herein illustrated as consisting of operational amplifiers, monitor the intrusion signals ITA, ITB, ITC and the tamper input signal TMP respectively. A threshold voltage level $V_{R1}$ equivalent to 50% of the power supply voltage ($V_{SS}$–$V_{DD}$) serves as the threshold voltage levels for the comparator circuits A1 and A4. The threshold voltage level $V_{R2}$, herein defined as being 20% of the supply voltage ($V_{SS}$–$V_{DD}$) serves as the threshold voltage input for the comparator circuits A2 and A3. The logic network consisting of NOR gates A5, A6, A7, A8, A9 and inverters A10, A11, A12, and A13 are connected in a circuit arrangement so as to respond to the digital output levels $A_I$, $B_I$ and $C_I$ of comparator circuits A1, A2 and A3 to satisfy the truth table of FIG. 4B.

FIRE COMPARATORS AND LOGIC CIRCUIT B

Figures 5A, 5B:
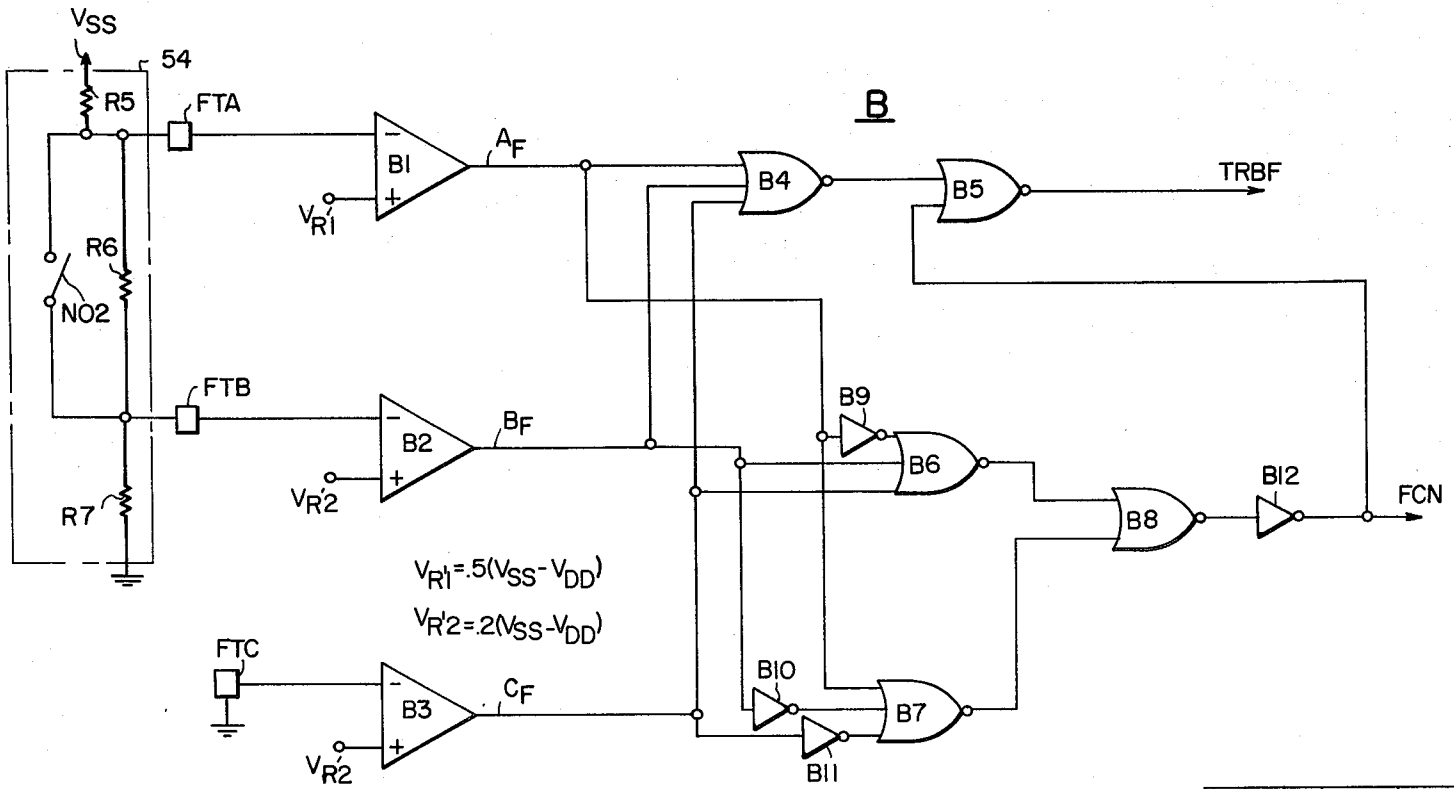
FIG. 5A is a schematic illustration of a fire comparator analogic circuit for use in FIG. 3.
FIG. 5B is a truth table defining the operation of the circuit of FIG. 5A.

The purpose of circuit B, which is schematically illustrated in FIG. 5A, is to monitor analog signals developed in response to the conditions of normally open contact NO2 of the fire sensor 54 in fire loop FL and produce signal FCN if a fire condition exists and signal TRBF if a trouble condition exists, such as the failure of resistors R5, R6 or R7. Comparator circuits B1, B2 and B3 monitor the voltage levels FTA, FTB and FTC respectively developed by the fire loop FL. In the embodiment of FIG. 5A, the threshold voltage level $V'_{RL}$ of the comparator circuit B1 is 50% of the supply voltage ($V_{SS}$–$V_{DD}$) while the threshold voltage levels $V'_{R2}$ for the comparator circuits B2 and B3 are 20% of the supply voltage as indicated. The output voltage levels $A_F$, $B_F$ and $C_F$ of comparator circuits B1, B2 and B3 respectively are supplied as input signals to a NOR logic circuit consisting of NOR gates B4, B5, B6, B7, and B8 and inverters B9, B10, B11, and B12 which satisfy the truth table of FIG. 5B.

EXIT/ENTRY TIMER AND ARM AND INTRUSION LATCHES CIRCUIT C

Figure 6A:
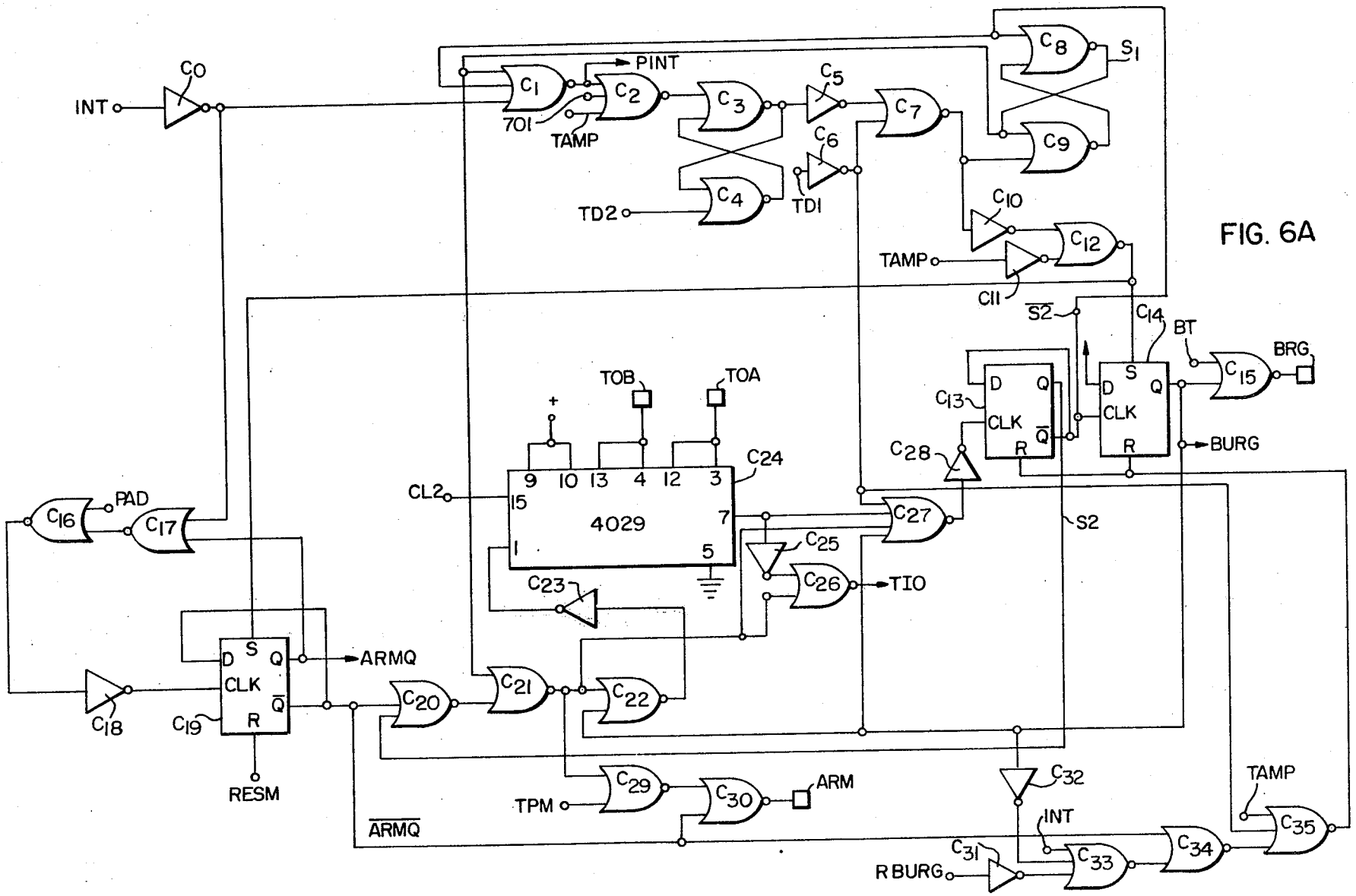
FIG. 6A is a schematic illustration of an exit and entry timers/arm and intrusion latch circuit for use in FIG. 3 and FIGS. 6B, 6C, 6D, 6E, 6F and 6G are pulse graphs illustrating the operation of the circuit of FIG. 6A.
Figure 6B:
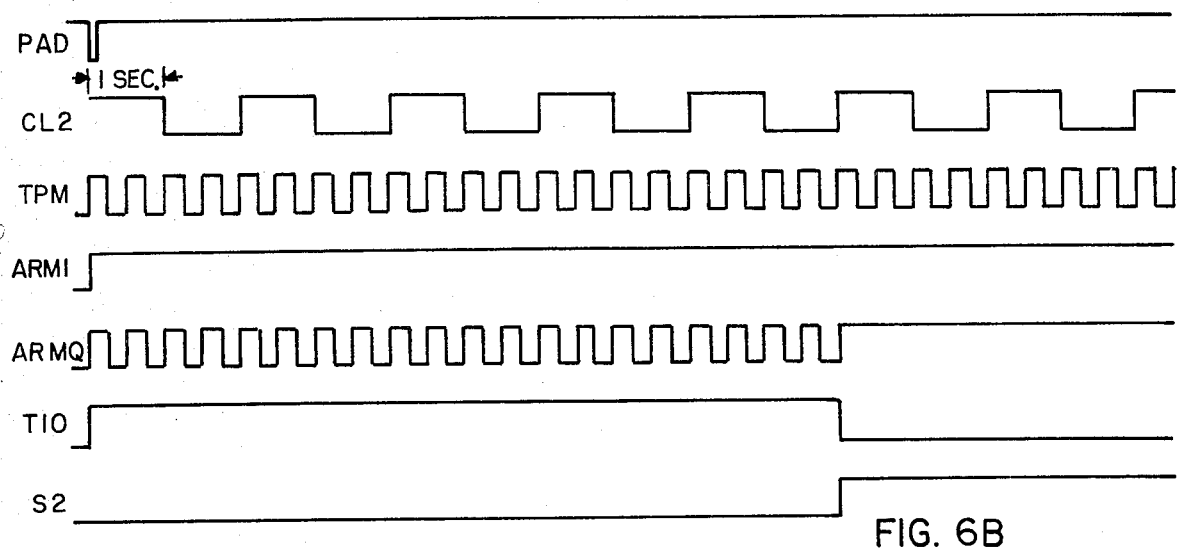
Figure 6C:
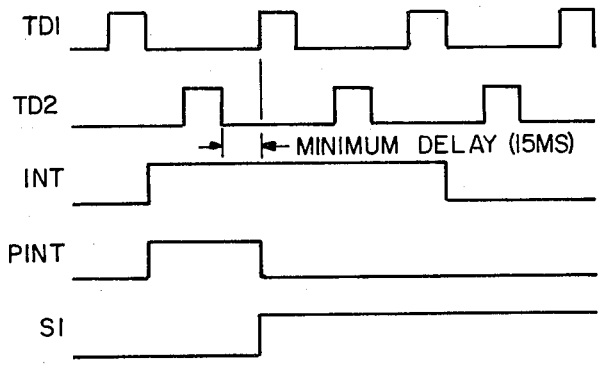
Figure 6D:
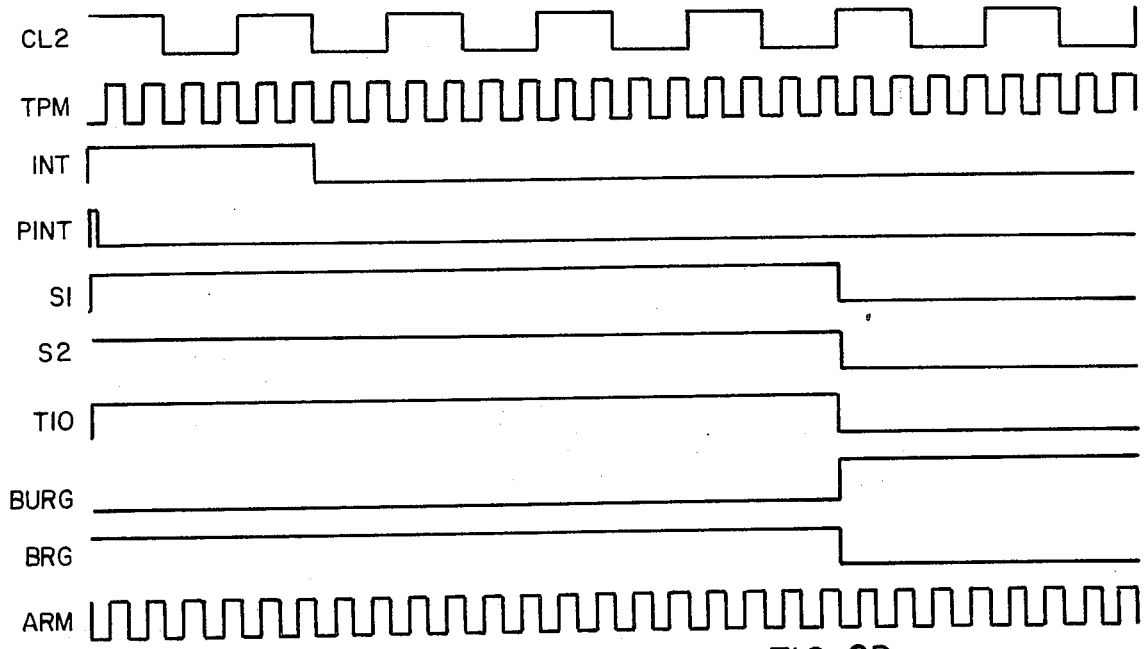
Figure 6E:
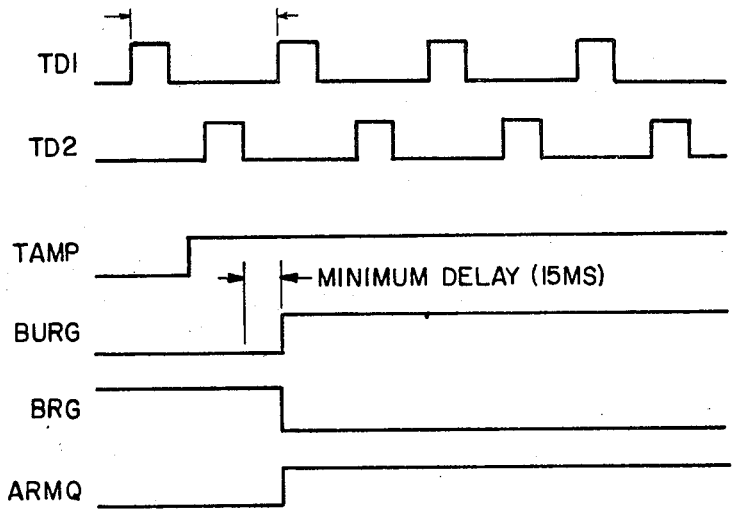
Figure 6F:
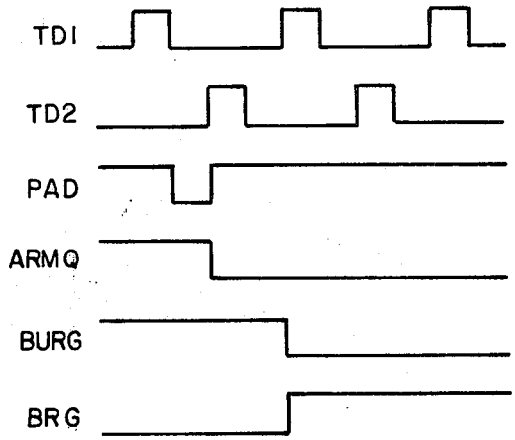
Figure 6G:
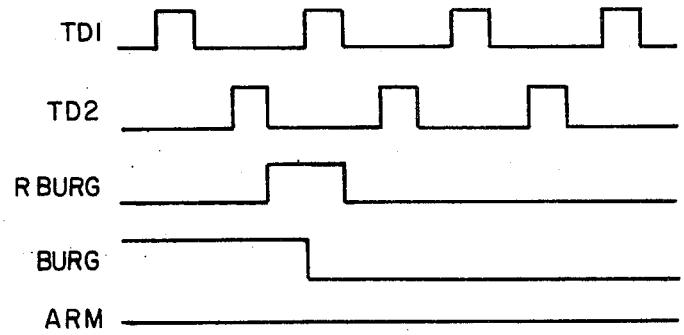

The circuit C, of which a typical embodiment is schematically illustrated in FIG. 6A, provides the following functions:

1. Allows arming of the intrusion sensors 52 and provides a programmable time delay (time-out) between an arming actuation and the actual arming of the circuit.

2. Once the intrusion circuits 52 are armed, circuit C provides a programmable time delay (time-in) from the detection of an intrusion to activation of the BURG signal to permit authorized personnel sufficient time to disarm the intrusion circuits.

3. Provides programmable delays of 0, 10, 20 and 30 seconds.

4. Provides direct setting of the intrusion latch of circuit C with the TAMP signal without the need of arming and without the time-in and time-out functions.

5. Provides a minimum time delay for detection of the INT and TAMP signals thereby providing capability of rejecting pulses shorter than that corresponding to the minimum time delay of 15 milliseconds.

6. Provides the ARM output signals which indicates arm, disarm, time-in, time-out, and intrusion conditions.

When the intrusion circuits 52 are disarmed, the ARM output is a logic 0 and when the intrusion circuits 52 are armed, the ARM output is a logic 1. During the conditions of time-in, time-out and when the BURG signal is a logic 1, the ARM output is a 2 Hz square wave.

The following discussion of a time-out sequence, assuming the initial conditions listed below, will provide a clear understanding of the circuit C.

Assume for the purposes of the following discussion that the following initial conditions exist:

Signals INT, TAMP, RESM, RBURG, ARMQ, BURG, S2, S1 and ARM are all logic 0. Signal TPM is a 2 Hz square wave and signal CL2 is a ½ Hz square wave.

With signal INT a logic 0, the output of inverter CO is a logic 1 causing the output of NOR gate C17 to be a logic 0. This allows the PAD signal to control the output of NOR gate C16 which is supplied to inverter C18 as a clock input to the 'D' type flip-flop circuit C19. Flip-flop C19 is wired as a toggle flip-flop such that the PAD signal will cause it to change state resulting in a logic 1 level at the Q output of the flip-flop C19, which corresponds to the signal ARMQ. Since, as assumed above, signals S1, S2 and BURG are logic 0, the $\overline{ARMQ}$ signal developed at the $\overline{Q}$ output of the flip-flop C19 will pass through NOR gates C20, C21 and C22 as well as inverter C23 and serve to release the present enable input signal to the four stage downcounter C24. Also, at this time, the ARM output signal changes from a logic 0 to a 2 Hz square wave by gating signal TPM through NOR gates C29 and C30. The carry-out signal from terminal 7 of the downcounter C24 is a logic 1 and when supplied to inverter C25 appears as a logic 0 level at an input to the NOR gate C26. A second input to the NOR gate C26 is a logic 0 level developed at the output of NOR gate C21. The logic 0 levels at the inputs of the NOR gates C26 develop a logic 1 level at the output of NOR gate C26 which corresponds to signal TIO. The signal TIO functions to enable the Noise Generator and System Timing Circuit J through the Alarm Priority Logic Circuit I. Downcounter C24 will count down at a ½ Hz rate from a present count value established by input signals TOA and TOB until the lowest state of counter C24 is reached. At this time, the carry-out signal of the downcounter C24, appearing at terminal 7, changes from a logic 1 to a logic 0 and in so doing forces signal TIO to a logic 0. Under these conditions, the timing signal TD1 is transmitted through inverter C6, NOR gate C27 and inverter C28 to the clock input of D type flip-flop circuit C13 and functions to toggle flip-flop circuit C13 such that signal S2, developed at the Q output of flip-flop C13, changes from a logic 0 to a logic 1. The $\overline{S2}$ signal, which is developed at the $\overline{Q}$ output of flip-flop C13, functions to enable NOR gates C1 and C8 while signal S2 disables NOR gate C20 thereby forcing the output of NOR gate C21 to a logic 1 and changing the ARM output from the 2 Hz square wave TPM signal to a logic 1. The final circuit conditions are the same as existed at the start except that the signals ARMQ, ARM and S2 are logic 1. The timing sequence of the operation of the schematic illustration of FIG. 6A corresponding to a 10 second delay, wherein signal TOA is a logic 0 and signal TOB is a logic 1, as illustrated in the pulse graph representation of FIG. 6B.

The time-in delay function of circuit C begins when signal S1 changes to a logic 1. Assuming signal S1 to be logic 0 when the signal INT goes to a logic 1, all inputs to the NOR gate C1 are logic 0. This forces the output of NOR gate C1, which corresponds to signal PINT to a logic 1 and the output of NOR gate C2 to a logic 0. This allows the output of NOR gate C3, which is cross-coupled with NOR gate C4, to change to a logic 1 when the timing signal TD2 goes to a logic 1.

When this occurs, the output of inverter C5 goes to a logic 0, thus allowing timing signal TD1 to pass through inverter C6 and NOR gate C7 to set the NOR gate flip-flop formed by NOR gates C8 and C9 thereby changing the signal S1 to a logic 1. Signal S1 then disables NOR gate C1 causing signal PINT to return to a logic 0. This sequence is illustrated in the pulse graph representation of FIG. 6C.

With signal S1 a logic 1, the output of NOR gate C21 is forced to a logic 0 causing the ARM output of NOR gate C30 to be a 2 Hz square wave, and the output of NOR gate C26, which corresponds to signal TIO, to change to a logic 1. The logic 0 output condition of NOR gate C21 causes the output of inverter C23 to release the preset enable condition of downcounter C24. The downcounter C24 will count down until the carry-out signal generated at terminal 7 changes to a logic 0, forcing signal TIO to a logic 0 and allowing signal TD1 to be transmitted through inverter C6, NOR gate C27 and inverter C28 to toggle flip-flop C13 to change signal S2 from a logic 1 to a logic 0. The toggling of flip-flop C13 causes signal S1 to change to a logic 0 and further toggles D type flip-flop C14 such that the BURG signal goes to a logic 1 and the output of NOR gate C15, which corresponds to output signal BRG, is a logic 0. the BURG signal disables NOR gates C22 and C27 thus causing the preset enable of downcoutner C24 to return to a logic 1. With the signals ARMQ and S2 at a logic 0, the output of NOR gate C20 is a logic 1 which forces the output of NOR gate C21 to logic 0 thus allowing the output signal ARM to continue as a 2 Hz square wave. At the end of this sequence, signals S1, S2 and output BRG are logic 0's while signal BURG is a logic 1. This sequence is illustrated in the pulse graph representation of FIG. 6D.

The signal TAMP is used to set the D type flip-flops C14 and C19 regardless of previous circuit logic conditions. When the signal TAMP goes to a logic 1 the output of the NOR gate C2 changes to a logic 0 thus allowing the output of NOR gate C3 to change to a logic 1 when the timing signal TD2 becomes a logic 1. This enables NOR gate C7, through inverter C5, thereby causing the output of NOR gate C7 to follow signal TD1. The output of NOR gate C7 is supplied to inverter C10 as one input to NOR gate C12 while the TAMP signal is supplied to inverter C11 as a second input to NOR gate C12. If the signal TAMP is still a logic 1 at this time, the output of the NOR gate C12 will change to a logic 1 thus forcing flip-flop C14 to change the BURG signal to a logic 1 and the ARMQ output of flip-flop C19 to a logic 1. This sequence of operation is illustrated in pulse graph representation of FIG. 6E.

Once the signals BURG and ARMQ are logic 1, the PAD signal will change them both to a logic 0. With ARMQ at a logic 1 and the output of NOR gate C17 a logic 0, the PAD signal will toggle flip-flop C19 to a logic 0 through NOR gate C16 and inverter C18. At this time signal $\overline{\text{ARMQ}}$ will change to a logic 1, forcing the output of NOR gate C34 to a logic 0 thus allowing NOR gate C35, with the TAMP signal at a logic 0, to reset flip-flops C13 and C14. This sequence of operation is illustrated in the pulse graph representation of FIG. 6F.

Signal RBURG is also capable of resetting flip-flops C13 and C14. The signal RBURG goes to a logic 1 four minutes, 14 seconds after signal BURG goes to a logic 1, if the input signal A/M is a logic 0 (See FIG. 9A). The BURG signal is supplied through inverter C32 as an input to NOR gate C33. If the INT signal is logic 0 the output of NOR gate C33 will be logic 1, forcing the output of NOR gate C34 to a logic 0 thereby allowing timing signal TD1 to be transmitted by NOR gate C35 to reset flip-flops C13 and C14. When this occurs, signals BURG and S2 will go to a logic 0. The outut of NOR gate C33 will be forced to a logic 0, thus forcing the output of NOR gate C34 to a logic 1 and removing the reset signals from flip-flops C13 and C14. Since the signal ARMQ is a logic 1, the time-out sequence previously described will occur, leaving signal ARMQ at a logic 1, signal S2 at a logic 1 and signal BURG at a logic 0. This sequence, wherein signal TOA is a logic 0 and signal TOB is a logic 1, is illustrated in the pulse graph representation of FIG. 6G.

The time-in and time-out delays of circuit C are programmable in accordance with the following relationship:

| TOA | TOB | DELAY (Seconds) |
|---|---|---|
| 0 | 0 | 0 |
| 0 | 1 | 10 |
| 1 | 0 | 20 |
| 1 | 1 | 30 |

FIRE LATCH CIRCUIT D

Figure 7A:
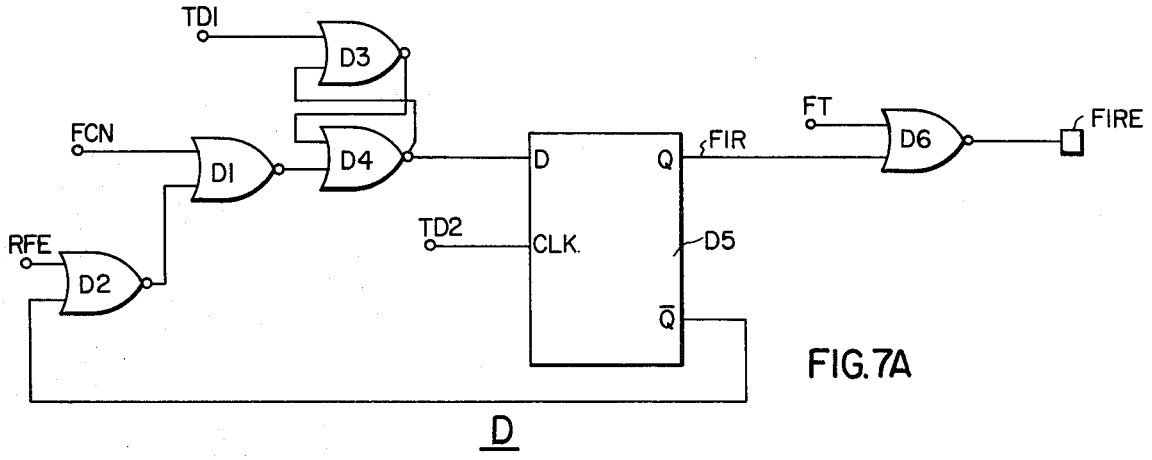
FIG. 7A is a schematic illustration of a fire latch circuit for use in FIG. 3
Figure 7B:
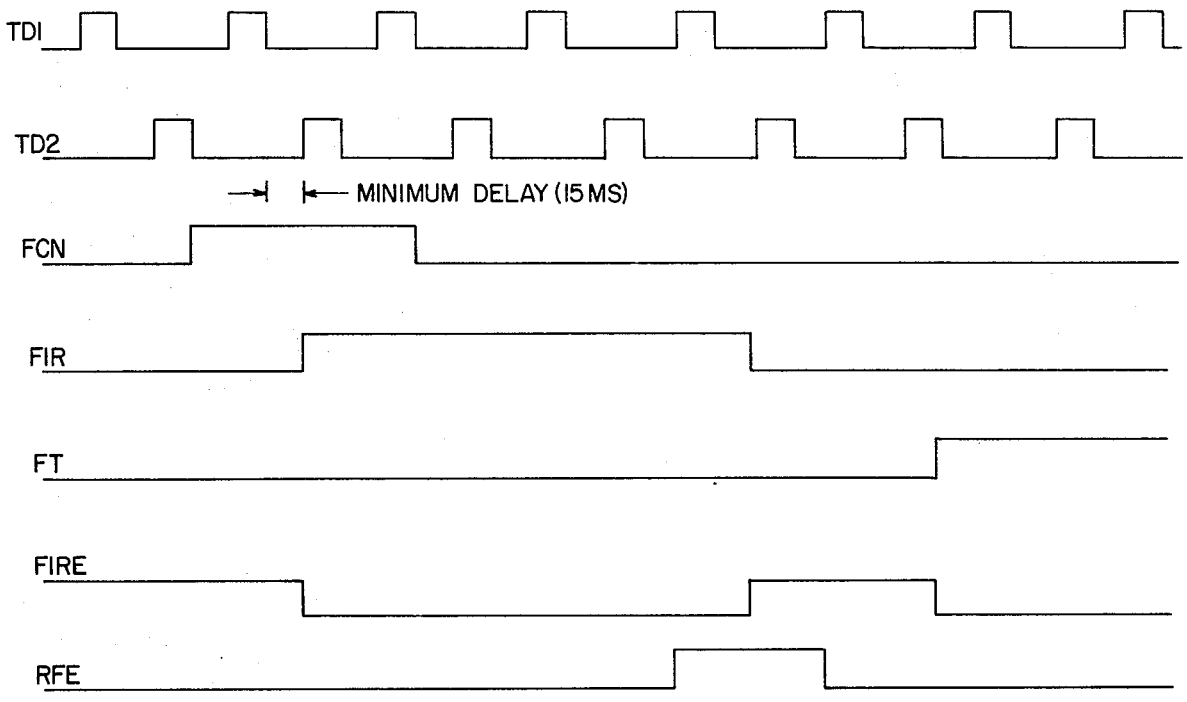
FIG. 7B is a pulse graph illustrating the operation of the circuit of FIG. 7A.

The purpose of the fire latch circuit D, which is schematically illustrated in FIG. 7A, is to latch signal FCN after a minimum delay of 15 milliseconds provided by timing signals TD1 and TD2 and to further provide the outputs signal FIRE indicative of the presence of a fire alarm condition.

Signals RFE, FCN and FIR are normally logic 0. When signal FCN changes to a logic 1 the output of the NOR gate D1 goes to a logic 0. This allows the output of NOR gate D4 to go to a logic 1 when the signal TD1, which is transmitted through NOR gate D3 as an input to NOR gate D4, goes to a logic 1. When the timing signal TD2, which serves a clock input to D type flip-flop circuit D5, goes to a logic 1, the FIR signal developed at the Q output of the flip-flop D5 goes to a logic 1 forcing the output of the NOR gate D6 to a logic 0. The $\overline{Q}$ output of the flip-flop D5, which is connected as an input to the NOR gate D2, will change to a logic 0 causing the output of the NOR gate D2 to change to a logic 1 this in turn forces the output of NOR gate D1 to a logic 0, even if the input signal FCN should return to a logic 0. Under these conditions, the FIR signal is latched to a logic 1.

Signal RFE functions to restore the FIR signal to a logic 0 when the input signal FCN returns to a logic 0. When RFE goes to a logic 1, the output of the NOR gate D2 changes to a logic 0 thus allowing the output signal NOR gate D4 to follow the FCN signal. The FT signal, which is appleid as a second input signal to the NOR gate D6, is derived from the Test Sequence Logic Circuit G and causes a change in the output signal FIRE during a test sequence. The timing sequence of the operation of the cirucit 7A is illustrated in the pulse graph of FIG. 7B.

EMERGENCY LATCH CIRCUIT E

Figure 8A:
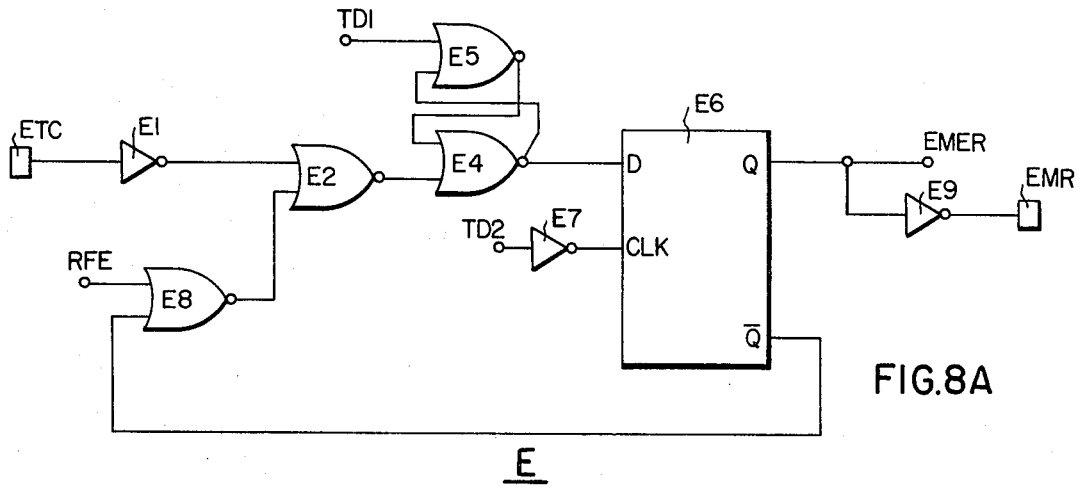
FIG. 8A is a schematic illustration of an emergency latch circuit for use in FIG. 3.
Figure 8B:
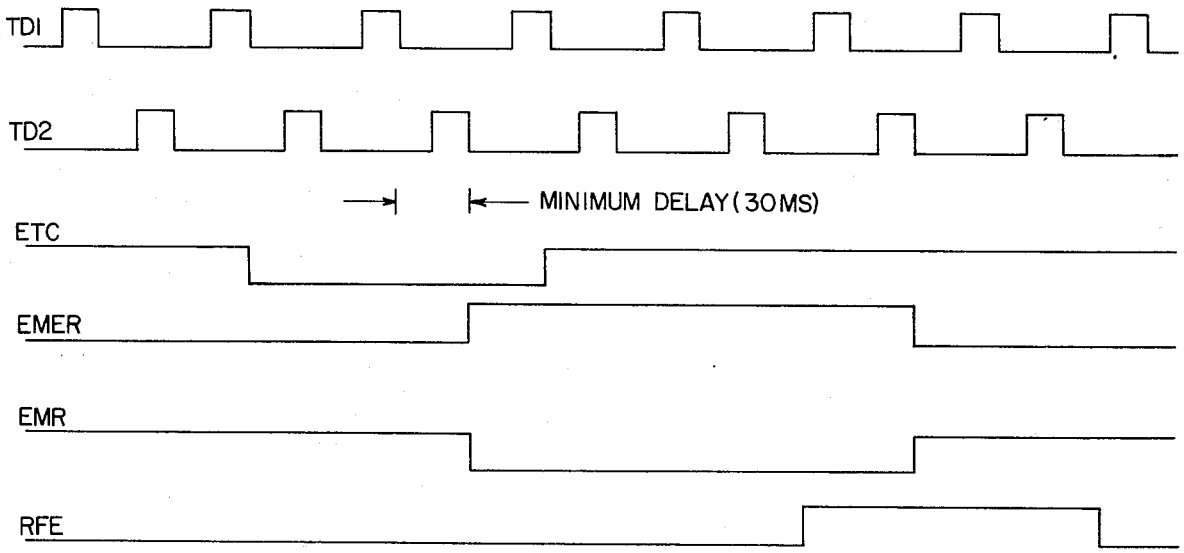
FIG. 8B is a pulse illustrating the operation of the circuit of FIG. 8A.

The purpose of the emergency latch circuit E, which is schematically illustrated in FIG. 8A, is to latch the input signal ETC after a minimum delay of 30 milliseconds provided by timing signals TD1 and TD2, and generate the output signal EMR in response to an emergency condition. The operation of the schematic embodiments of FIG. 8A is illustrated in a pulse graph of FIG. 8B.

Under non-alarm conditions, signals RFE and EMER are logic 0 and signal ETC is a logic 1.

When the signal ETC goes to a logic 0, and responds to the actuation of the emergency buttom 32, the output of the inverter E1 goes to a logic 1 and the output of the NOR gate E2 goes to a logic 0, thus allowing the output of the NOR gate E4 to change to a logic 1 when the timing signal TD1, which is transmitted through NOR gate E5 as an input to NOR gate E4 goes to a logic 1. The Q output of the D type flip-flop E6 will change to a logic 1 when the timing signal TD2, which functions as a clock input through the inverter E7, goes to a logic 0. The $\overline{Q}$ output of flip-flop E6, which serves as an input to NOR gate E8, changes to a logic 0. The output of the NOR gate E8 is forced to a logic 1 thereby latching the input signal ETC. Input signal RFE, which is applied to NOR gate E8, restores the EMER output signal of the flip-flop E6 to a logic 0 when the ETC signal returns to a logic 1. EMR alarm output signal is developed as a result of the EMER output signal of flip-flop which is applied to the inverter E9.

When input signal RFE goes to a logic 1, the output of the NOR gate E8 goes to a logic 0, thus allowing the input to the flip-flop E6 from the NOR gate E4 to follow the output of the inverter E1.

ARM/DISARM RESET LOGIC AND TIMER CIRCUIT F

Figure 9B:
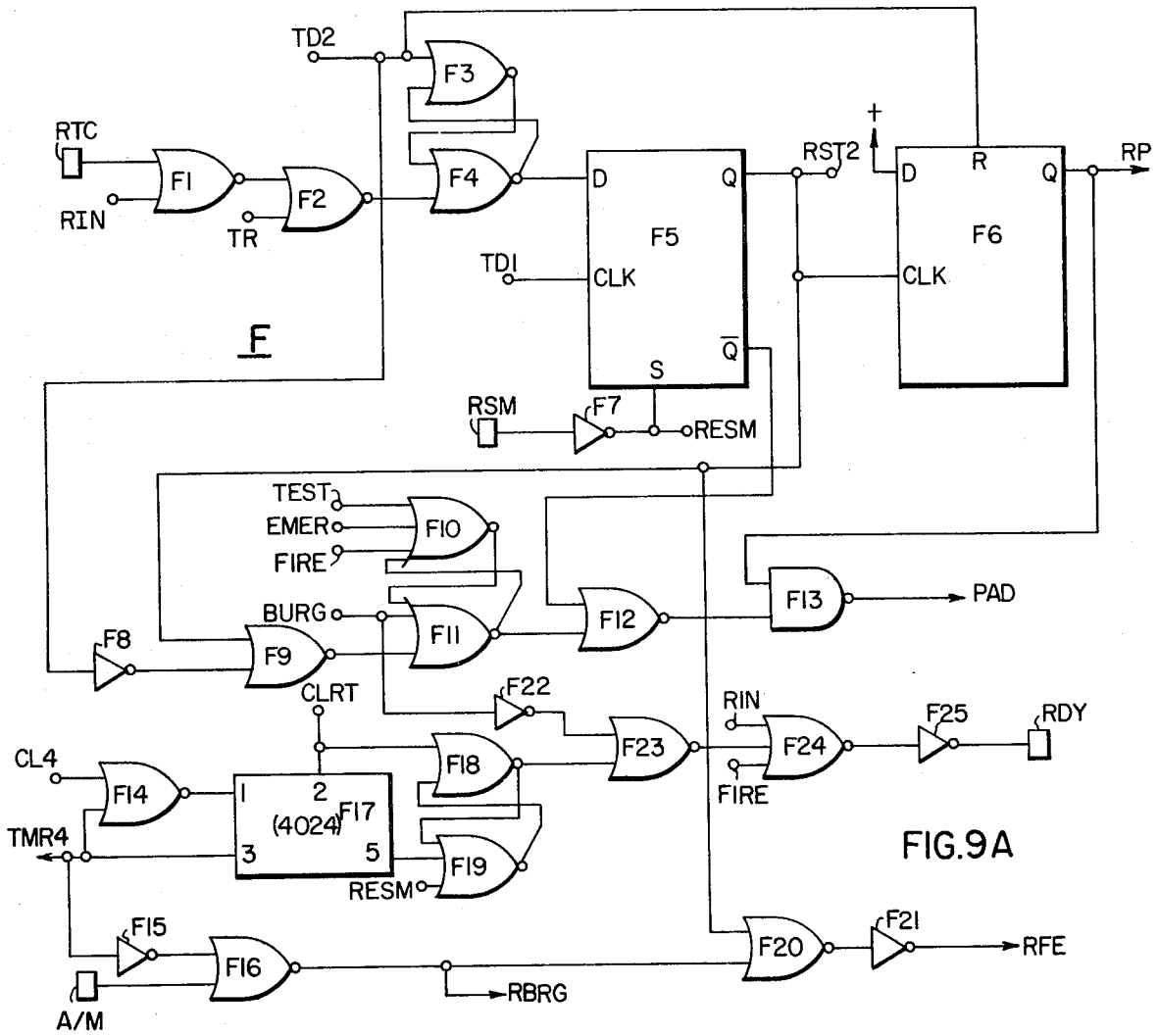
FIG. 9B is a pulse graph illustrating the operation of the circuit of FIG. 9A.
Figure 9B:
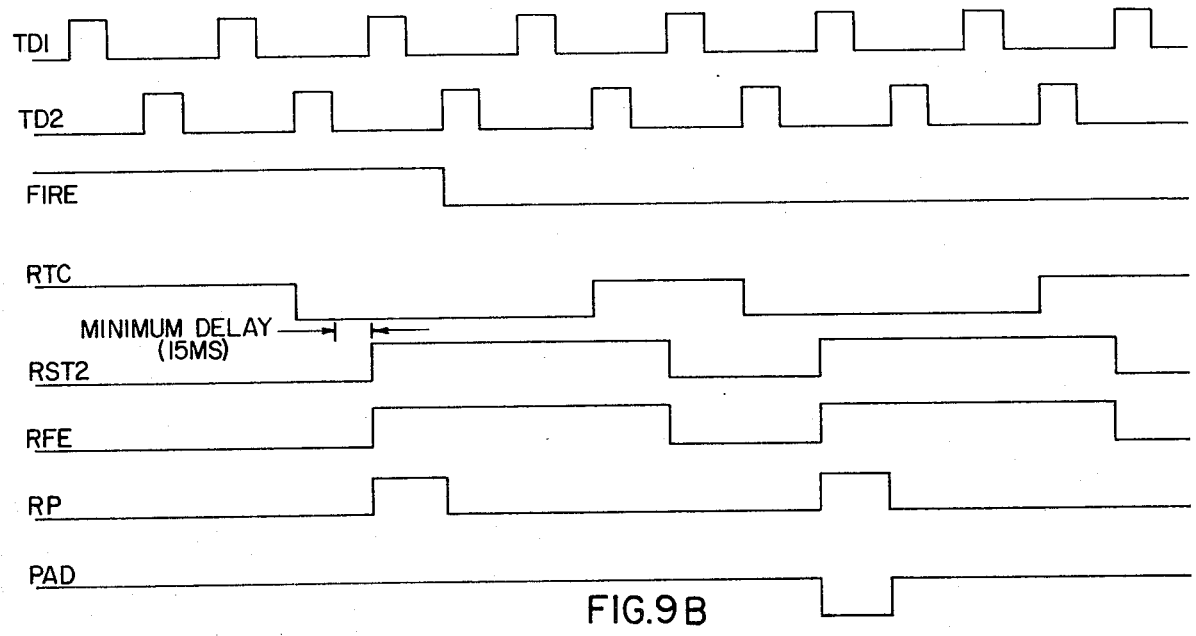

The purpose of ciruit F, which is schematically illustrated in FIG. 9A, is to provide resetting, toggling and resynchronizing signals to the other circuits of FIG. 3 as a function of the state of the input signals RTC, RSM and A/M, in addition to providing the output signal RDY which indicates that an intrusion alarm condition has been latched for at least one minute, or that the test sequence initiated by circuit G is complete.

The RTC input signal serves the dual function of arming and disarming circuit C and resetting the latch functions of circuits C and E. The RTC input signal will always function to disarm the latch function of circuit C and reset the latch functions of cirucits C and E. However, input signal RTC will only arm the intrusion function if the latching function of circuits D, E and G have been reset.

Initially, the input signals RTC, A/M and RSM are logic 1. Signals RIN, TR, BURG, TEST and EMER are logic 0 while signal FIRE is a logic 1. When the input signal RTC goes to a logic 0 in response to the initiation of a reset signal by either the code lock buttons 34 of FIG. 1 or the key lock K of FIG. 2, the output of the NOR gate F1 goes to a logic 1 forcing the output of NOR gate F2 to a logic 0. A logic 0 output of NOR gate F2 allows the output of Nor gate F4 to change to a logic 1 when the timing signal TD2, which is applied through NOR gate F3 as an input to NOR gate F4 is a logic 1. In this instance, when the signal TD1, which is applied as the clock input to D type flip-flop F5, changes from a logic 0 to a logic 1, the Q output of flip-flop F5, which corresponds to signal RST2, will change to a logic 1. This change in the Q output of flip-flop F5 forces the output of NOR gate F20 to a logic 0 and the output of inverter F21, which corresponds to signal RFE, to a logic 1. Referring to Fire Latch Circuit D schematically illustrated in FIG. 7A, the logic 1 condition of signal RFE will cause signal FIRE to change to a logic 1. The RST2 signal from the Q output of flip-flop F5 is supplied as a clock input to D type flip-flop circuit F6 causing the Q output of flip-flop F6, which corresponds to signal RP, to change from a logic 0 to a logic 1 until signal TD2 goes to a logic 1 and resets flip-flop F6. The signal RP is used to resynchronize the timing signals from Noise Generator and System Timing Circuit J.

The Q output of flip-flop circuit F6 is also used as an input to NAND gate F13 to form the output signal PAD which is used to toggle flip-flop C19 of circuit C. Since the FIRE signal of the Fire Latch Circuit D of FIG. 7A is a logic 1 when the signal RST2 changes to a logic 1, thus causing the output of NOR gate F10 to a logic 0, the output of the NOR gate F11 is a logic 1 and the output of NOR gate F12 is a logic 0, thus preventing the output of NAND gate F13 from changing from a logic 1 to a logic 0.

The occurrence of signal RFE will cause the signal FIRE to change to a logic 0. However, the output of NOR gate F11 will not change since the signal RST2 is forcing the output of NOR gate F9 to a logic 0. A change in the input signal RTC to a logic 1 causes signal RST2 to change to a logic 0 which allows the timing signal TD2 to pass through inverter F8 and NOR gate F9 to change the output of NOR gate F11 to a logic 0. When the input signal RTC returns returns to a logic 0, the signal RST2 will change to a logic 1 and since the output of NOR gate F12 is a logic 1, the PAD signal will appear at the output of NAND gate F13 and will toggle the flip-flop circuit C19 of the Exit and Entry Timer/Arm and Intrusion Latch circuit C of FIG. 6A. The operation of circuit F to this point is illustrated in the pulse graph of FIG. 6B.

Input signal RTC works in the identical manner described above for the EMR signal.

The test signal RIN is a logic 1 for the first nine seconds of the test sequence thereby disabling NOR gate F1 for this period. Signal TR is used to reset the EMR, FIRE and BURG signals generated during the test sequence initiated by the Test Sequence Logic Circuit G. When the BURG signal is a logic 1, the PAD signal is not disabled by the output of NOR gate F11 since the BURG signal forces the output of the NOR gate F11 to a logic 0.

The RSM input signal is a master reset signal which is supplied to inverter F7 to generate signal RESM which is applied to the set input of the flip-flop F5 causing the RST2 signal from the Q output to change to a logic 1. The RESM signal developed at the output of inverter F7 is also supplied as an input to the NOR gate F18 to establish a logic 1 at the output of NOR gate F18.

The one and four minute timer function of circuit F is provided by the combination of NOR gate F14 and a seven-stage counter circuit F17. The CLRT signal is a pulse signal that functions to clear counter F17, reset the flip-flop formed by the NOR gates F18 and F19 and to resynchronize the square wave clock signal CL4. The output of the fifth stage of counter circuit F17, identified as terminal 5, causes the output of NOR gate F18 to change to a logic 1. With the clock signal CL4 at a four second period, the change in the output logic level of NOR gate F18 will occur 62 seconds after the clearing pulse CLRT. The output of the NOR gate F18 will remain at a logic 1 until the next CLRT pulse.

Signal TMR4, which corresponds to the output of the seventh stage of counter F17 herein identified as terminal 3, will change to a logic 1 254 seconds (4 minutes and 14 seconds) after the last CLRT pulse and will remain at a logic 1 since the output of the NOR gate F14 is forced to a logic 0.

The logic output of NOR gate F18 as reflected by the output of NOR gate F19 in combination with the BURG signal supplied to inverter F22 are transmitted through NOR gate F23 to serve as an input in combination with signals FIRE and RIN to NOR gate F24. The output of NOR gate F24 as supplied through inverter F25 produces the RDY signal. With signals RIN or FIRE at a logic 1, the output of NOR gate F24 is a logic 0 and the RDY signal is a logic 1. With signals RIN and FIRE at a logic 0, the RDY signal is a logic 1 only if the BURG signal is a logic 1 and the output of the NOR gate F18 is a logic 0, thus forcing the output of NOR gate F23 to a logic 1.

During a test sequence initiated by the Test Sequence Logic Circuit G, the RDY signal is a logic 1 for the first nine seconds. During the time the BURG signal is a logic 1, the RDY signal is a logic 1 for the first 62 seconds.

Signal TMR4 is used to automatically reset the BURG, FIRE and EMER signals if the A/M input signal is a logic 0. With the A/M signal at a logic 0, the output of NOR gate F16, which corresponds to signal RBRG, is a logic 1, and the RFE signal developed at the output of inverter F21 will also be a logic 1.

TEST SEQUENCE LOGIC CIRCUIT G

Figure 10A:
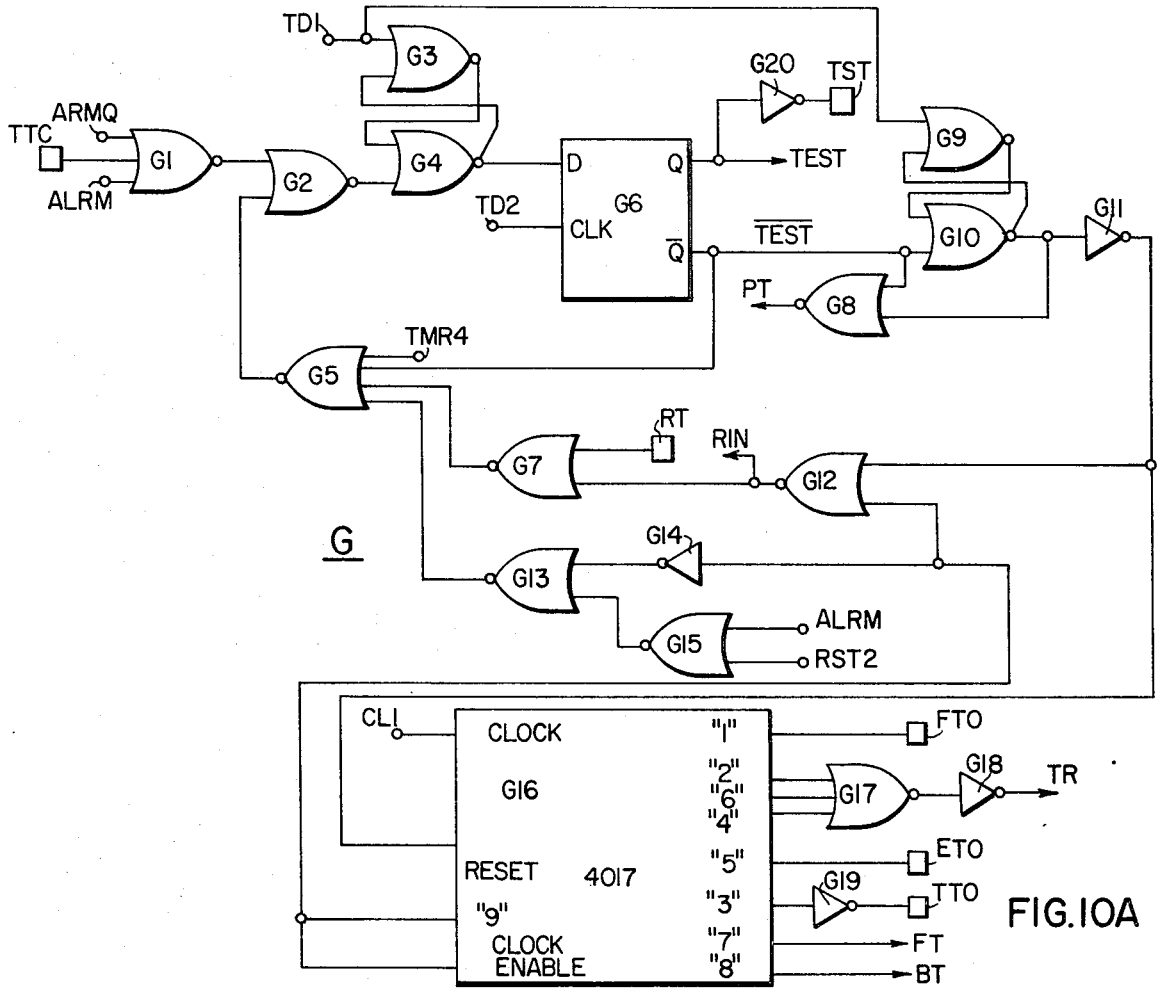
FIG. 10A is a schematic illustration of a test sequence logic circuit for use in FIG. 3.
Figure 10B:
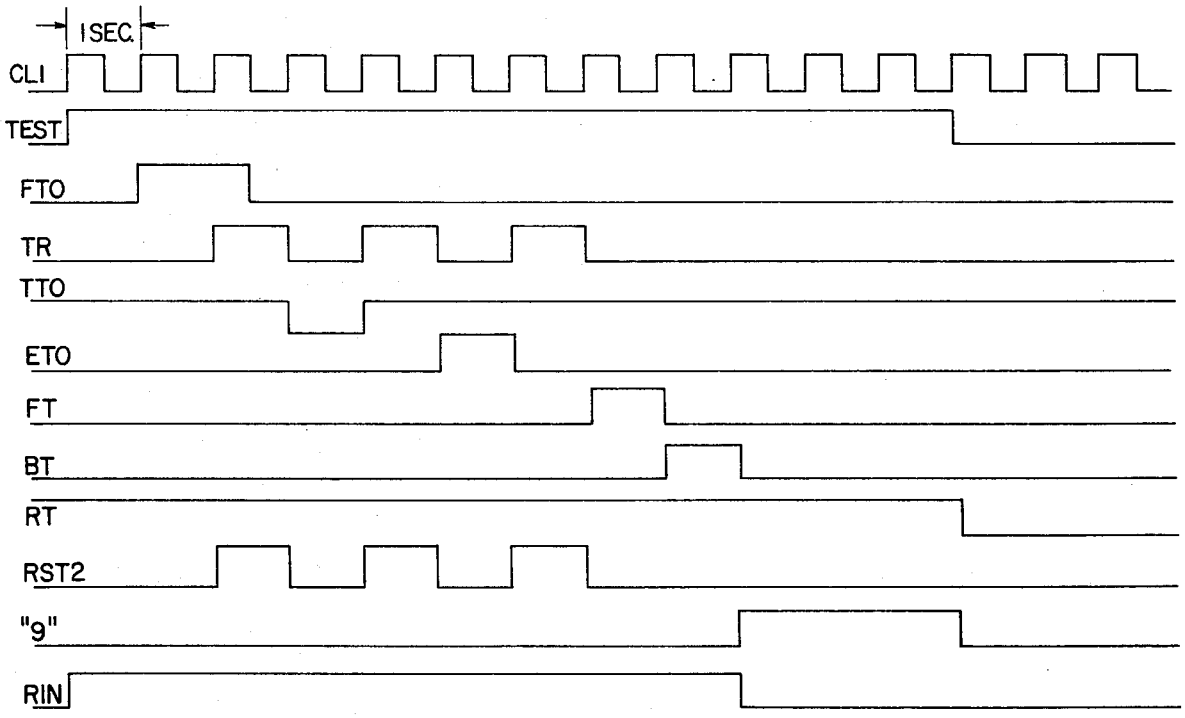
FIG. 10B is a pulse graph illustration of the operation of the circuit of FIG. 10A.

The purpose of circuit G, a typical embodiment of which is schematically illustrated in FIG. 10A, is to provide an automatic testing sequence for the security system 10 by providing external signals FTO, TTO and ETO for testing the fire, tamper and emergency supervisory loops respectively as well as providing internal signals TR for automatic resetting and BT and FT for testing the BRG output of circuit C and the FIRE output of circuit D respectively. The test sequence is initiated by the actuation of test button 36 which develops input signal TTC and the test sequence is terminated by the occurrence of signals RT, RST2, TMR4 or ALRM.

In the absence of the actuation of the test button 36, the TTC signal is normally a logic 1. The TTC signal controls the output of NOR gate G1 only when signals ARMQ and ALRM are logic 0. When the signal TTC changes to a logic 0 in response to the actuation of the test button 36, it either signal ARMQ or ALRM is a logic 1, the test sequence is disabled.

Assuming, however, the ARMQ and ALRM signals are a logic 0, a change of the TTC signal from a logic 1 to a logic 0 will cause the output of NOR gate G1 to go to a logic 1 thus forcing the output of NOR gate G2 to a logic 0. A logic 0 at the output of NOR gate G2 permits the output of NOR gate G4 to change to a logic 1 when the timing signal TD1 applied to the NOR gate G3 becomes a logic 1. The logic 1 output of NOR gate G4 is applied as an input to the D type flip-flop G6. When the clock input signal TD2 of flip-flop G6 changes to a logic 1, the TEST signal developed at the Q output of G6 becomes a logic 1. The resulting logic 0 signal developed at the $\overline{Q}$ output of the flip-flop G6 establishes logic 0 levels at both inputs of NOR gate G8 thereby establishing signal PT at a logic 1. This condition remains until timing signal TD1, which is supplied as an input to NOR gate G9, resets the flip-flop circuit formed by the NOR gates G9 and G10. The output of NOR gate G10 is coupled through the inverter G11 to the reset input 15 of the tenstate Johnson counter G16. When the output of NOR gate G10 changes to a logic 1, the logic 0 output of the inverter G11 releases the reset input to the counter G16 and develops a logic 1 at the output of NOR gate G12, which output corresponds to the signal RIN. The logic 1 level of the signal RIN as applied as an input to NOR gate G7 produces a logic 0 at the output of NOR gate G7. With the resetting of the counter G16 the 9 output of the counter G16 will be a logic 0 thus producing a logic 1 at the output of inverter G14 which serves as an input to the NOR gate G13. The logic 1 input to the NOR gate G13 in turn results in a logic 0 at the output of NOR gate G13. Inasmuch as signal PT has forced signal TMR4 to a logic 0 (refer to circuits I and F), all signals into NOR gate G5 are logic 0 thus resulting in a logic 1 at the output of NOR gate G5. The logic 1 at the output of NOR gate G5 in turn produces a logic 0 at the output of NOR gate G2 thereby latching the TEST signal to a logic 1. The TEST signal will remain a logic 1 until the counter G16 reaches the 9 state at which time NOR gate G12 and inverter G14 will permit ALRM, RST2, RT, or TMR4 signals to disable NOR gate G5 thus establishing the TEST signal at a logic 0. The operation of the logic circuitry of FIG. 10A is illustrated in the pulse graph representation of FIG. 10B.

Once this test sequence is started, a clock signal CL1, which is a square wave with a one second period, causes counter G16 to sequence from state 0 to state 9. When state 9 is reached, the clock is disabled and remains in this state until one of the signals TMR4, ALRM, RST2 or RT cause the TEST signal to change to a logic 0. This sequence is illustrated in the pulse graph representation of FIG. 10C.

TROUBLE LOGIC CIRCUIT H

Figure 11A:
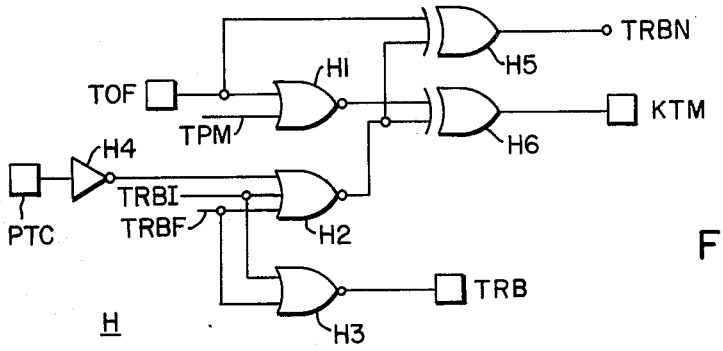
FIG. 11A is a schematic illustration of a trouble logic circuit for use in FIG. 3.
Figure 11B:
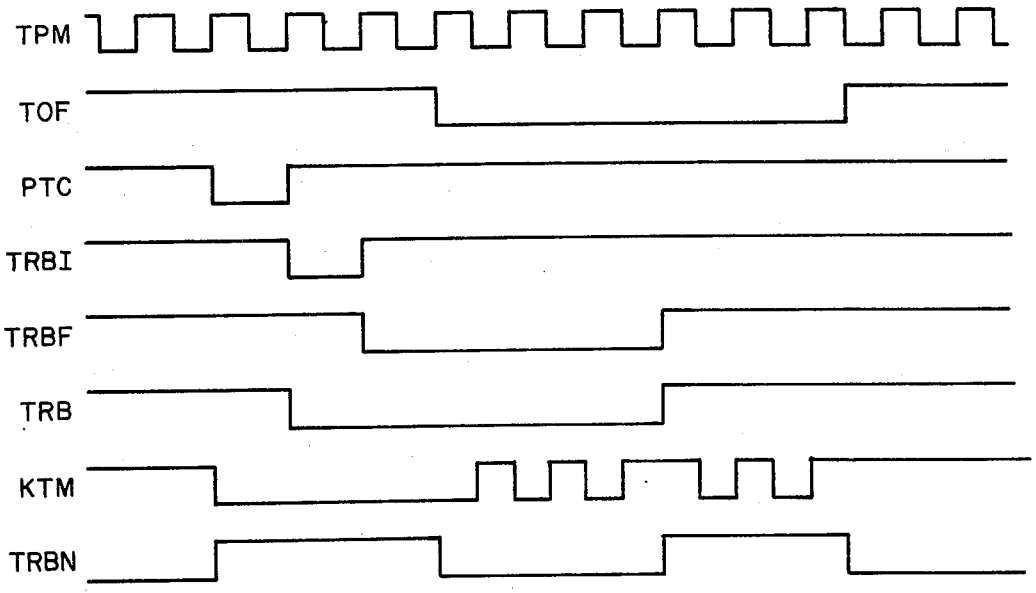
FIG. 11B is a pulse graph illustration of the operation of the circuit of FIG. 11A.

The purpose of the Trouble Logic Circuit H, a typical embodiment of which is schematically illustrated in FIG. 11A, is to provide the TRBN signal to the Alarm Priority Logic Circuit I and to further provide output signals KTM and TRB which are logically a function of signals TOF, PTC, TRBI, TRBF and clock signal TPM. The TRB output signal is an indication of a supervisory malfunction associated with the intrusion sensors 52 and fire sensors 54. Signals TRBI and TRBF are input signals to NOR gates H2 and H3. In the event either signal TRBI or TRBF is a logic 1, the output of the NOR gate H3, which corresponds to signal TRB, will be a logic 0. When a trouble condition exists as would be the case if input signal PTC, which is supplied through inverter H4 as an input to NOR gate H2, or output signal TRB is a logic 0, then the output of NOR gate H2 is a logic 0. The logic level of the output of NOR gate H2 is supplied as an input to exclusive OR gates H5 and H6. When the input signal TOF is at a logic 1, the output of NOR gate H1 is a logic 0, the KTM output signal of the exclusive OR gate H6 is a logic 0 and the TRBN output signal of the exclusive OR gate H5 is a logic 1. These output signal conditions result in an audible alarm output from the Alarm Priority Logic Circuit I which is indicative of the trouble condition.

If the input signal TOF is changed to a logic 0, the output of NOR gate H1 will be controlled by signal TPM, which is a 2 Hz square wave, and the KTM output signal of the exclusive OR gate H6 will be a 2 Hz square wave. Simultaneously therewith, output signal TRBN becomes a logic 0 thereby terminating an audio output waveform from the Alarm Priority Logic Circuit I.

In the situation where no trouble conditions exist, the output of the NOR gate H2 is a logic 1. With the input signal TOF a logic 1, the TRBN output signal of the exclusive OR gate H5 is a logic 0 and the KTM output signal of the exclusive OR gate H6 is a logic 1. Now, if the input signal TOF is changed to a logic 0, the 2 Hz square wave input signal TPM is gated through NOR gate H1 and exclusive OR gate H6 causing the output signal KTM of exclusive OR gate H6 to be a 2 Hz square wave. The TRBN output signal of the exclusive OR gate H5 becomes a logic 1. The operation of the logic circuit schematically illustrated in FIG. 11A is illustrated in the pulse graph representation of FIG. 11B.

ALARM PRIORITY LOGIC CIRCUIT I

The Alarm Priority Logic Circuit I, of which a typical implementation is schematically illustrated in FIG. 12A, consists of logic components for generating external output signals LL, OUT, and ALARM and internal signals ALRM, CT, CF, and CB from external input signals TONE, INH, and SCI and internal signals FIR, BURG, EMER, TEST, TIO, TRB, TRBF, CLTR and TMR4. The Alarm Priority Logic Circuit I of FIG. 12B further includes circuitry to generate external output signal CST and internal signal CLRT. The operation of the logic of FIG. 12A to produce the indicated output signals is described in terms of the following Boolean equations wherein the ALARM output and the internal ALRM signal are used to indicate a logic 1 level for FIR, BURG, or EMER:

$$LL = TMR4 + \overline{ALRM}) \cdot TONE$$

$$ALRM = FIR + BURG + EMER$$

$$ALARM = \overline{ALRM}$$

$$\overline{CT} = ALRM + TIO + TEST + TONE$$

$$\overline{CF} = CT + \overline{ALRM} \cdot TRBF + FIR$$

$$\overline{CB} = CF \cdot [BURG + SCI]$$

The output signal OUT of circuit I, which is initiated by the Noise Generator and System Timing Circuit J by developing the appropriate signal FO, is represented as:

$$OUT = \overline{FO} \cdot INH \cdot [ALRM + TIO + TEST + TONE + TRBCLTR]$$

The nature of the signal TO is controlled by the signals CT, CF and CB.

The Alarm Priority Logic Circuit I determines from its inputs, which form of signal FO should be gated to the output terminal OUT and further determines the logic states of outputs LL, ALARM, and CST. Input signal INH, which is fed back from remote monitoring channels 60, functions to inhibit the signal developed at output terminal OUT during such intervals as that allocated for "talk-in".

The above Boolean equations describing the logic operations of the circuit of FIG. 12A to achieve the designated output signals, correspond to the logic NOR gates and inverters identified as 19–128. In addition to the circuit operations described above with regard to the operation of the Alarm Priority Logic Circuit I to control the initiation of audio waveforms by the Noise Generator and System Timing Circuit J, there is further included in circuit I, as schematically illustrated in FIG. 12B, logic circuitry to generate the external signal CST and the internal signal CLRT from signals FIRE, BURG, EMER, PT, PIN, TD1 and TD2. The output signal CST is a positive pulse which is generated each time signals FIR, BURG, or EMER change state, or when the TEST signal changes to a logic 1. Signal CLRT is a pulse signal used to clear the one minute and four minute functions of circuits F and to resynchronize the timing signals generated by the Noise Generator and System Timing Circuit J.

Exclusive OR gates I1, I2 and I5 and D type flip-flop I4 are connected so that the output of exclusive OR gate I5 will always go to a logic 1 when signals FIR and BURG, or signal EMER change state. The clocking signals supplied to circuits C and D are such that the FIR, BURG and EMER latches cannot change simultaneously. Flip-flop circuit I4 is clocked by timing signal $\overline{TD2}$, which is the output of the inverter I3, so that a minimum pulse width for output CST and signal CLRT is guaranteed. The output of exclusive OR gate 25, which is normally a logic 0, is supplied as an input to NOR gate I6. The second input to NOR gate I6 is signal PT, which is the pulse generated when the TEST signal changes to a logic 1. This pulse will be transmitted through NOR gates I7 and I8 and will appear as signals CST and CLRT respectively. Immediatedly following the signal PT, the signal RIN, which is an input to the NOR gate I7, changes to a logic 1 to prevent further pulses being generated at output CST during the nine second test sequence. Signal TD1 is used to prevent signal CLRT from resetting the one minute and four minute timing functions of circuit F when signal TD1 is a logic 1.

The operation of the circuit schematically illustrated in FIG. 12B is represented in the pulse graph of FIG. 12C.

NOISE GENERATOR AND SYSTEM TIMING CIRCUIT J

Figures 13A, 13B:
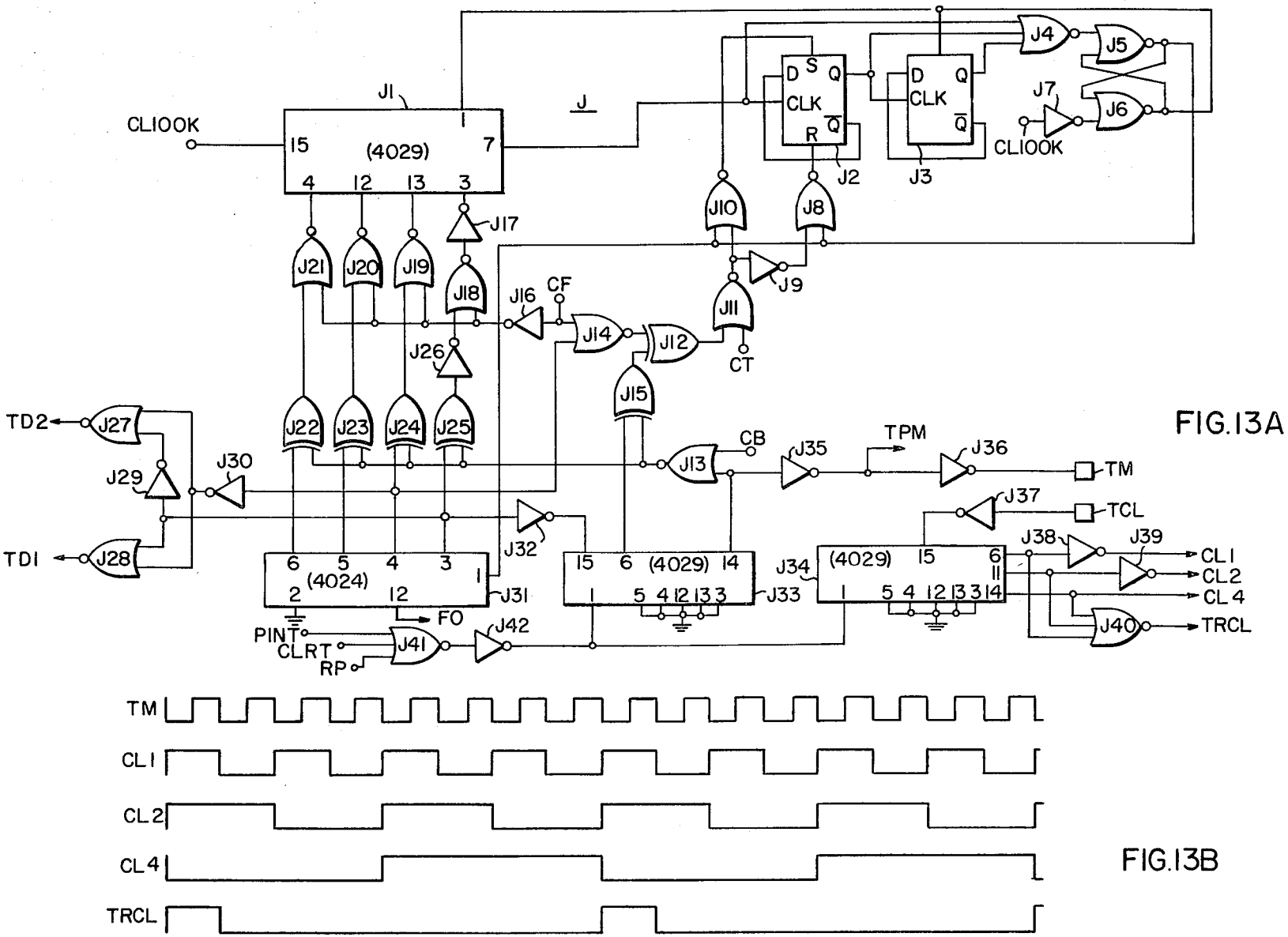
FIG. 13A is a schematic illustration of a noise generator and system timing circuit for use in FIG. 3.
FIG. 13B is a pulse graph illustrating the operation of the circuit of FIG. 13A.

The purpose of circuit J, a typical embodiment of which is schematically illustrated in FIG. 13A, is to generate the signal FO, a frequency modulated digital audio waveform which determines the audio output waveform at the output OUT of circuit I. When the signal OUT is used as a signal for external audio amplification via amplifier 37 of FIG. 1, the circuit J generates an audio waveform which is a function of the logic values of signals CT, CB and CF. The audio waveforms generated by the circuit J provide audible audio identification of the FIRE, BRG, EMR, TST, TRB, TRBF and TONE signals. Circuit J also generates system timing signals TD1, TD2, TPM, CL1, CL2, CL4 and TRLC as well as output signal TM which is intended to be connected to the input TCL under normal conditions. Input TCL is used as a test clock input to accelerate the system timing sequence when the integrated circuits forming the one-chip primary electronics 40 are undergoing functional testing.

The basic clock input to circuit J is signal CL100K which is generated by Clock Oscillator Circuit K. Circuit J is designed to operate with a nominal clock input of 97.28 KHz. This input need not be accurate in frequency since the only constraint is that the four minute timing function of circuit F must not be less than four minutes. With signal CL100K at 97.28 KHz, the four minute timing function of circuit F is four minutes and fourteen seconds. This indicates that signal CL100K may have a maximum frequency of (254/240) × 97.28 or 103 KHz. All other timing functions of the circuits of the primary electronics 40 are based on a clock input of 97.28 KHz.

The frequency modulated digital waveform FO is modulated over a range determined by the range of preset values available at the six stage downcounter consisting of four stage downcounter J1, D type flip-flops J2 and J3, NOR gates J4, J5 and J6, and inverter J7. Nor gate J4 decodes the lowest state of the six stage counter and sets the flip-flop formed by NOR gates J5 and J6. The output of NOR gate J6 and the output of NOR gate J5 are used to preset counter J1 and D type flip-flops J2 and J3. The preset pulse forces the output of NOR gate J4 to a logic 0. The subsequent passage of signal CL100K through inverter J7 resets the flip-flop formed by NOR gates J5 and J6 and removes the preset signal to counter J1. Since flip-flop J3 is always preset to a logic 1, while the other preset inputs are determined by the states of counters J31 and J33, the range of preset values for the six stage counter are 32 to 63. The preset pulse developed by the flip-flop formed by NOR gate J5 and J6 is applied as an input to counter J31 while signal FO is the output signal of the first state of counter J31.

The frequency range of signal FO is represented as:

$$\frac{97280}{126}\text{Hz} \leq FO \leq \frac{97280}{64}\text{Hz}$$

$$772\text{ Hz} \leq FO \leq 1520\text{ Hz}$$

Seven stage counter J31 and four stage counter J33 form an eleven stage counter wherein the fourth, fifth, sixth, seventh, eighth, and tenth stages determine the five preset states for counter J1 and flip-flop J2. This generalized feedback technique may be used to synthesize any type of frequency modulated digital waveforms desired. The additional constraint placed on circuit J is that signal TPM must be a square wave with a period of 0.5 seconds and be independent of the logic values of signals CT, CF and CB. When the output is a constant frequency resulting from input signal TONE, the timing signals are not utilized by the remainder of the circuit J. Otherwise for accurate timing, the average frequency must by 1024 Hz for all methods of frequency modulation.

There are four types of frequency modulated FO signals as determined by the signals CF, CB and CT. These are designated FIRE, BURG, EMER and TONE. The following logic tabulation illustrates the relationship of these FO signals with resepct to signals CF, CB and CT.

| | CF | CT | CB |
|---|---|---|---|
| FIRE | 0 | 0 | 1 |
| BURG | 1 | 0 | 0 |
| EMER | 1 | 0 | 1 |
| TONE | 0 | 1 | 1 |

For the TONE signal, CF is a logic 0 and the outputs of NOR gates J18, J19, J20 and J21 are also logic 0 while signal CT is a logic 1 which presets flip-flop J2 to a logic 1. This provides a fixed preset value of 56 for six stage counter J1, J2 and J3 and a contant output frequency of 868.6 Hz for signal FO. For the FIRE signal, CF is a logic 0 which again places a fixed preset value of 8 on the counter J1 and allows the output of the sixth stage of J33 to control NOR gate J14. With signal CB at a logic 1, the output of NOR gate J13 is a logic 0 which forces exclusive OR gate J15 to pass the output of the eighth stage of the counter J33 to the input of exclusive OR gate J12. With signal CT at a logic 0 the present value of flip-flop circuit J2 is a logic 1 when the sixth and eighth stages of counters J31 and J33 are equal, and a logic 0 when the two stages are not equal. This leaves the two possible preset values of 40 and 56 for the counter formed by J1, J2 and J3. The FIRE audio alarm includes two frequencies, i.e. 868.6 Hz and 1216 Hz. The output signal FO corresponding to the FIRE audio output waveform is graphically illustrated as a digitally modulated, frequency modulated digital audio waveform in FIG. 15 while Appendix A provides a numerical listing of frequency versus time for the waveform of FIG. 15.

When an intrusion alarm condition exists, signal CF is a logic 1 and signal CB is a logic 0. Under these conditions, if the output of the tenth stage of counter J1 is a logic 0, the preset values for counter J1 correspond to the outputs of the fourth, fifth, sixth, and seventh stages whereas if the logic output of the tenth stage is a logic 1 the present values for counter J1 correspond to the inverse of the output of the fourth, fifth, sixth and seventh stages of counter J31. This allows the preset values of counter J1 to have a range from 0 to 15 and to increment or decrement the preset values. With signal CT a logic 0, flip-flop J2 is preset to a logic 1 when the eighth and tenth stages are equal, and to a logic 0 when the stages are not equal. These conditions provide a range of preset values from 32 to 63 and a frequency range of 772 Hz to 1520 Hz.

Figure 16:
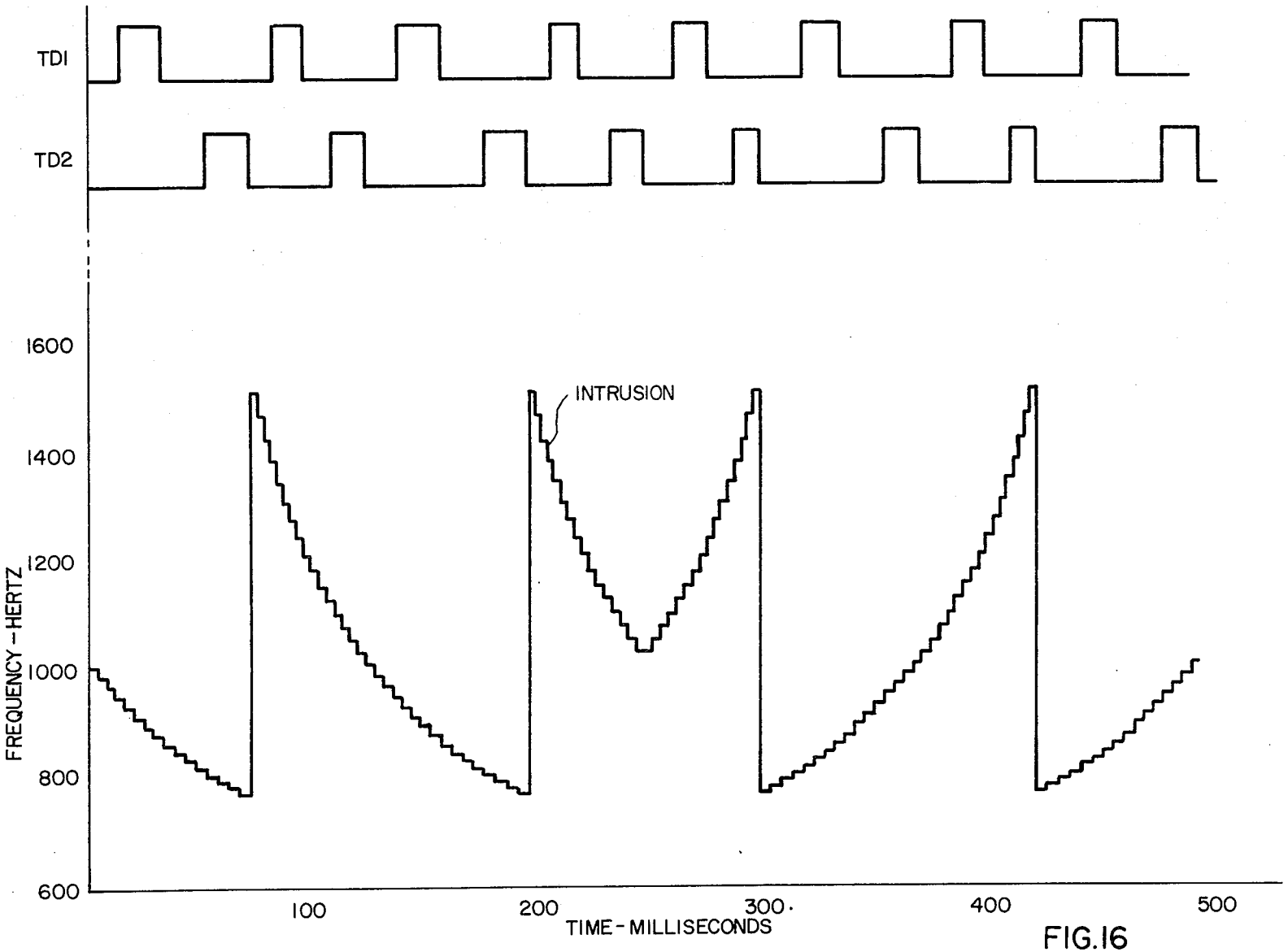

The audio output waveform developed by signal FO in response to an intrusion condition is graphically illustrated as a digitally modulated, frequency modulated digital audio waveform in the waveform of FIG 16 while Appendix B provides a numerical listing of frequency verseu time for the waveform of FIG. 16.

The occurrence of an emergency alarm condition establishes the same range of preset values as that established by an intrusion alarm condition. However, signal CB is a logic 1 in the event of an emergency condition with input SCI a logic 0 thus forcing the output of NOR gate J13 to a logic 0. This allows the preset values of the counter to decrement only. The first 500 milliseconds of the audible output waveform developed by signal FO in response to an emergency alarm condition is graphically illustrated as a digitally modulated, frequency modulated digital audio waveform in FIG. 17 while Appendix C is a numerical listing of frequency versus time for the waveform of FIG. 17.

Figure 15:
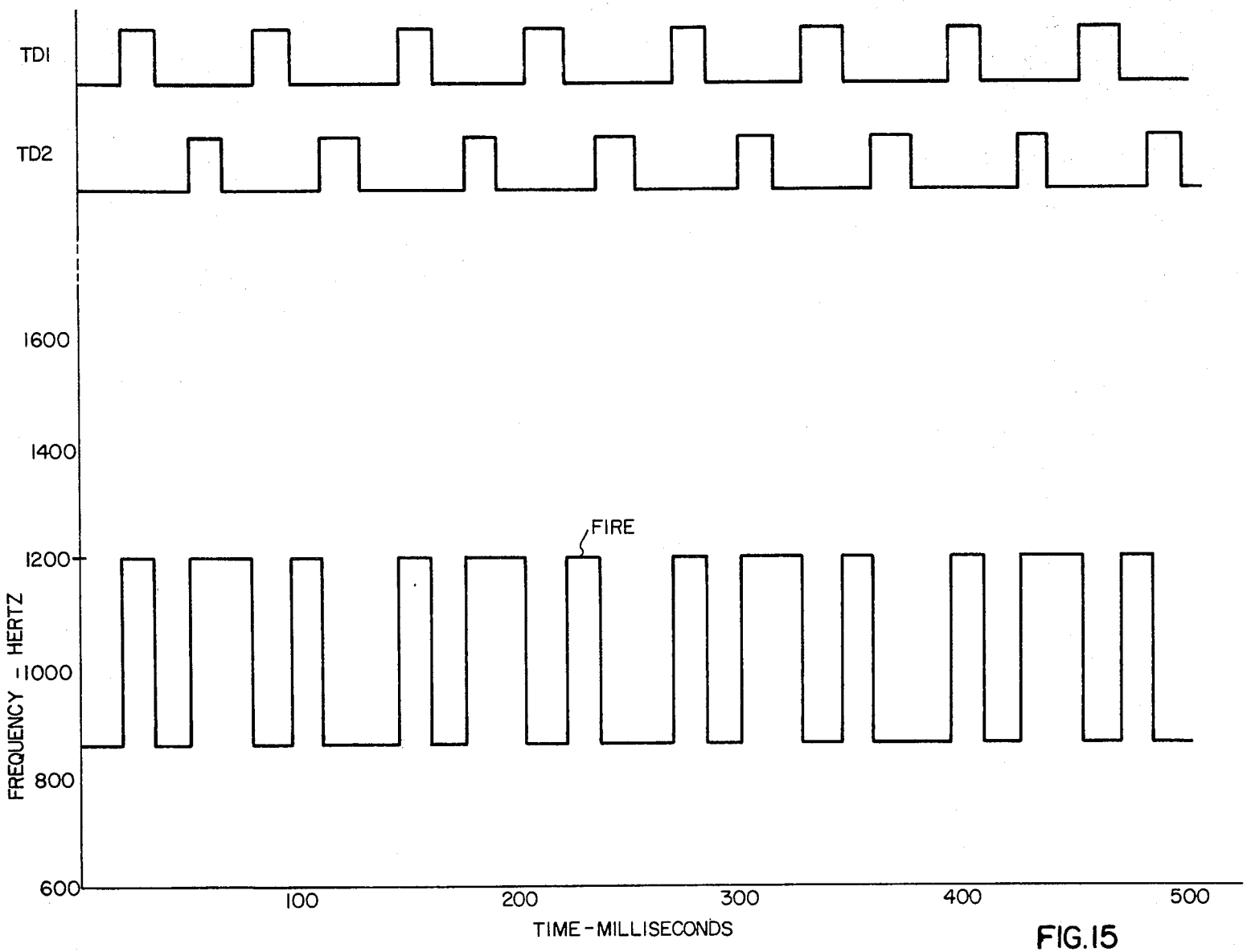
FIGS. 15, 16 and 17 are audio waveform illustrations of alarm conditions identified by the primary electronics of FIG. 3.
Figure 17:
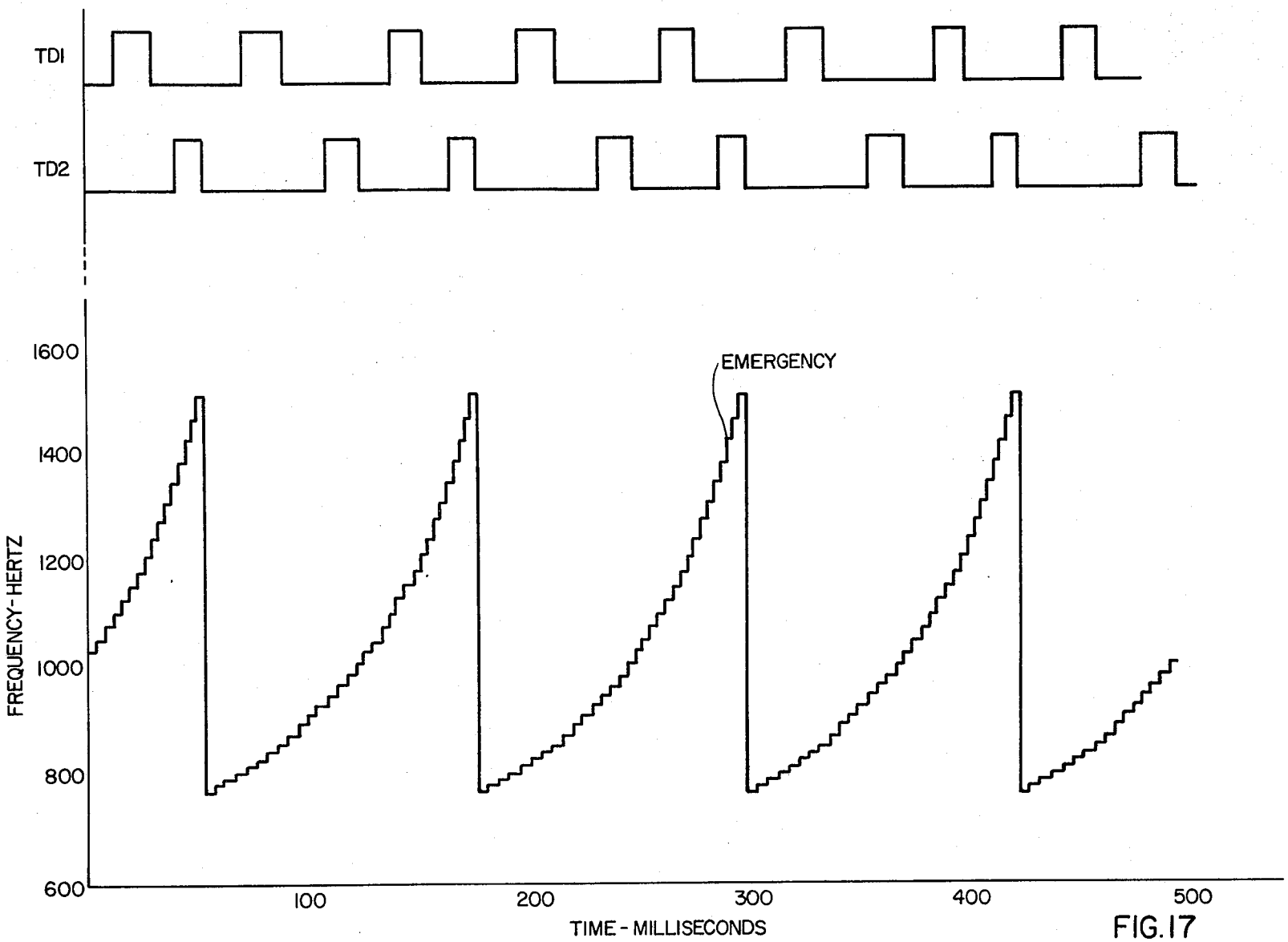

The digital modulation of the frequency modulated digital audio waveforms of FIGS. 15, 16 and 17 corresponds to the patterns of discrete steps or increments produced by the logic circuitry of FIG. 13A, which are documented in Appendices A, B and C, and which comprise the fire, intrusion and emergency digital audio waveforms respectively.

The timing signals TD1 and TD2 are developed by the NOR gates J27 and J28 and the inverters J29 and J30 in response to the outputs developed at the sixth and seventh stages of counter J31. Timing signals TD1 and TD2 occur at an average rate of 16 pulses per second and have an average pulse width of 15.625 milliseconds. The relationship of the timing signals TD1 and TD2 to the audio output waveforms characterizing a fire alarm, an intrusion alarm and an emergency alarm are graphically illustrated in FIGS. 15, 16 and 17 respectfully.

Additional timing signals generated by circuit J include TPM ($\overline{TM}$), CL1, CL2, CL4 and TRCL. The relationship of these additional timing signals is illustrated in the pulse graph representation of FIG. 13B. This assumes that the output TM is connected to the input TCL. Timing signal TRCL is used to gate the signal FO corresponding to an intrusion to the output OUT at a repetitious rate corresponding to 500 milliseconds ON and 3.5 seconds OFF when the signal TRB is a logic 1 and signal TRBF is a logic 0. When signal TRBF is a logic 1, the FO signal corresponding to a fire alarm is gated to the output OUT as alternate periods of 500 milliseconds of audio output waveform and 3.5 seconds of silence. This intermittent generation of audio output waveforms, wherein each trouble condition is characterized by a totally distinct audio waveform, permits direct audible identification of the trouble condition.

Timing signals PINT, CLRT and RP are pulses which control NOR gate J41 and inverter J42. Each time one of these pulses occurs, the timing signals TPM, TM, CL1, CL2, Cl4 and CLTR are reset and therefore resynchronized with the pulse that resets them.

CLOCK OSCILLATOR CIRCUIT K

Figure 14A:
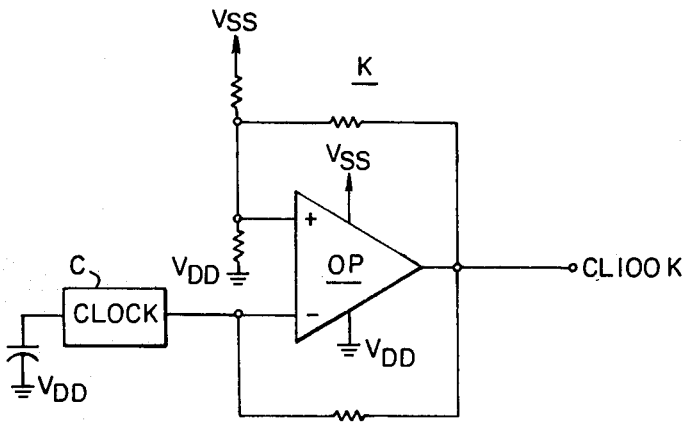
FIG. 14A is a schematic illustration of a clock oscillator circuit for use in FIG. 3.
Figure 14B:
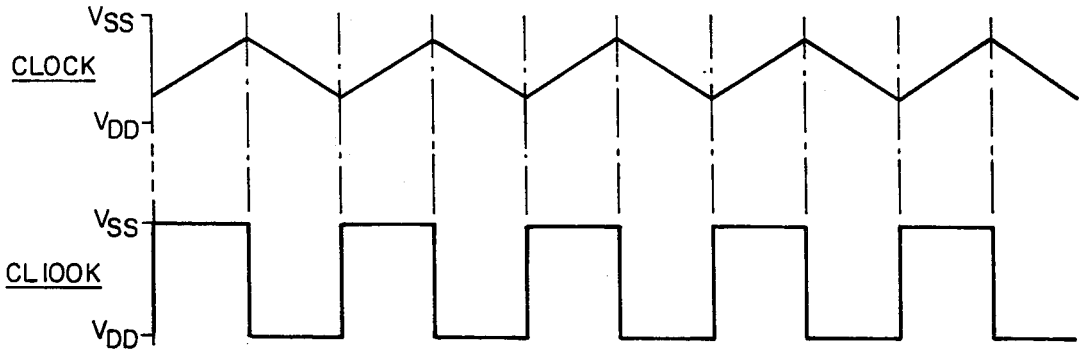
FIG. 14B is a waveform illustration of the output signals developed by the circuit of FIG. 14A.

The Clock Oscillator Circuit K, which is schematically illustrated in FIG. 14A, is a standard hysteresis oscillator utilizing positive feedback and resistor-capacitor timing. Circuit C develops the clock output waveform illustrated in FIG. 14B with the operational amplifier arrangement OP developing the square wave system timing signal CL100K illustrated in FIG. 14B.

Figure 18B:
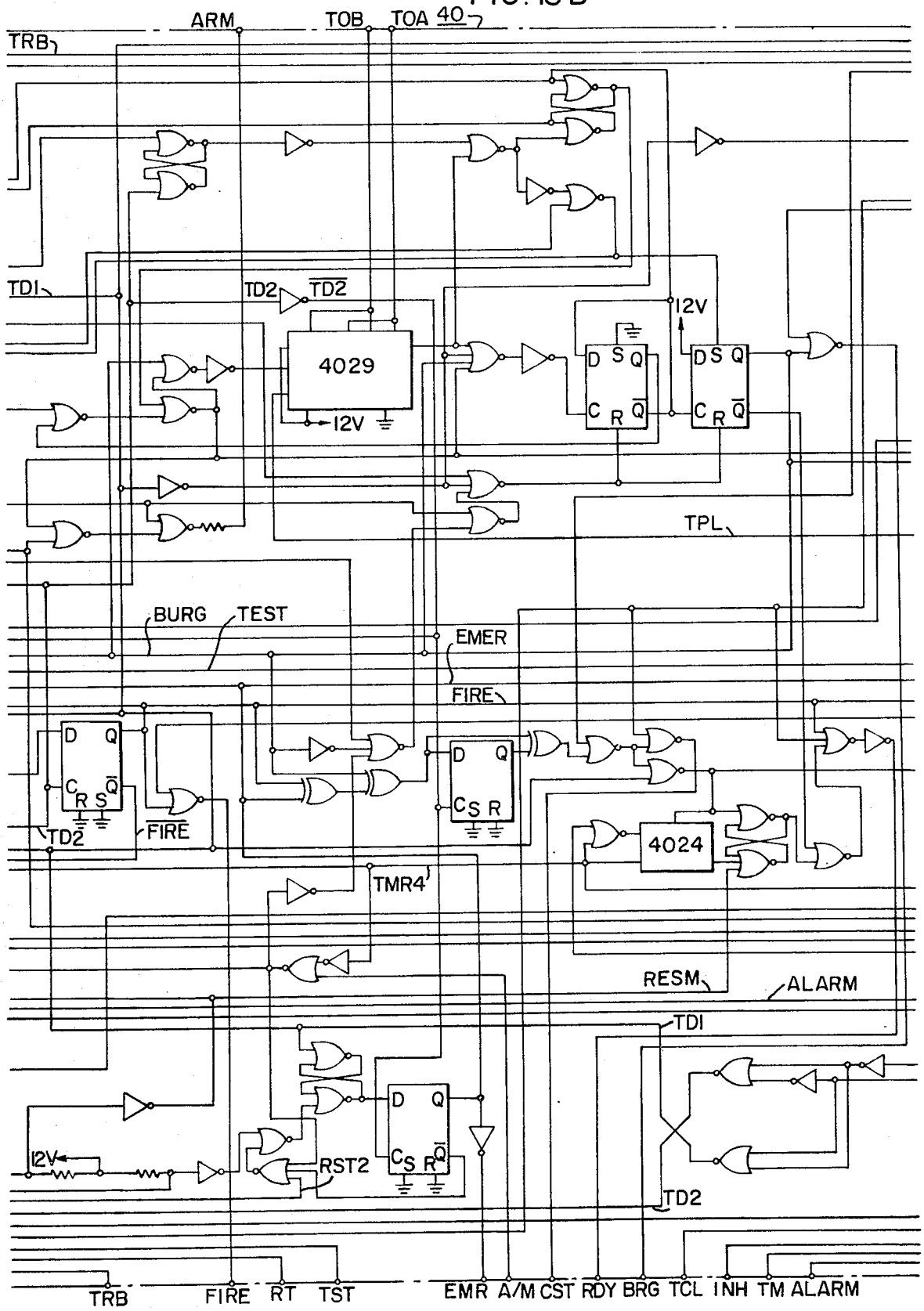
Figure 18C:
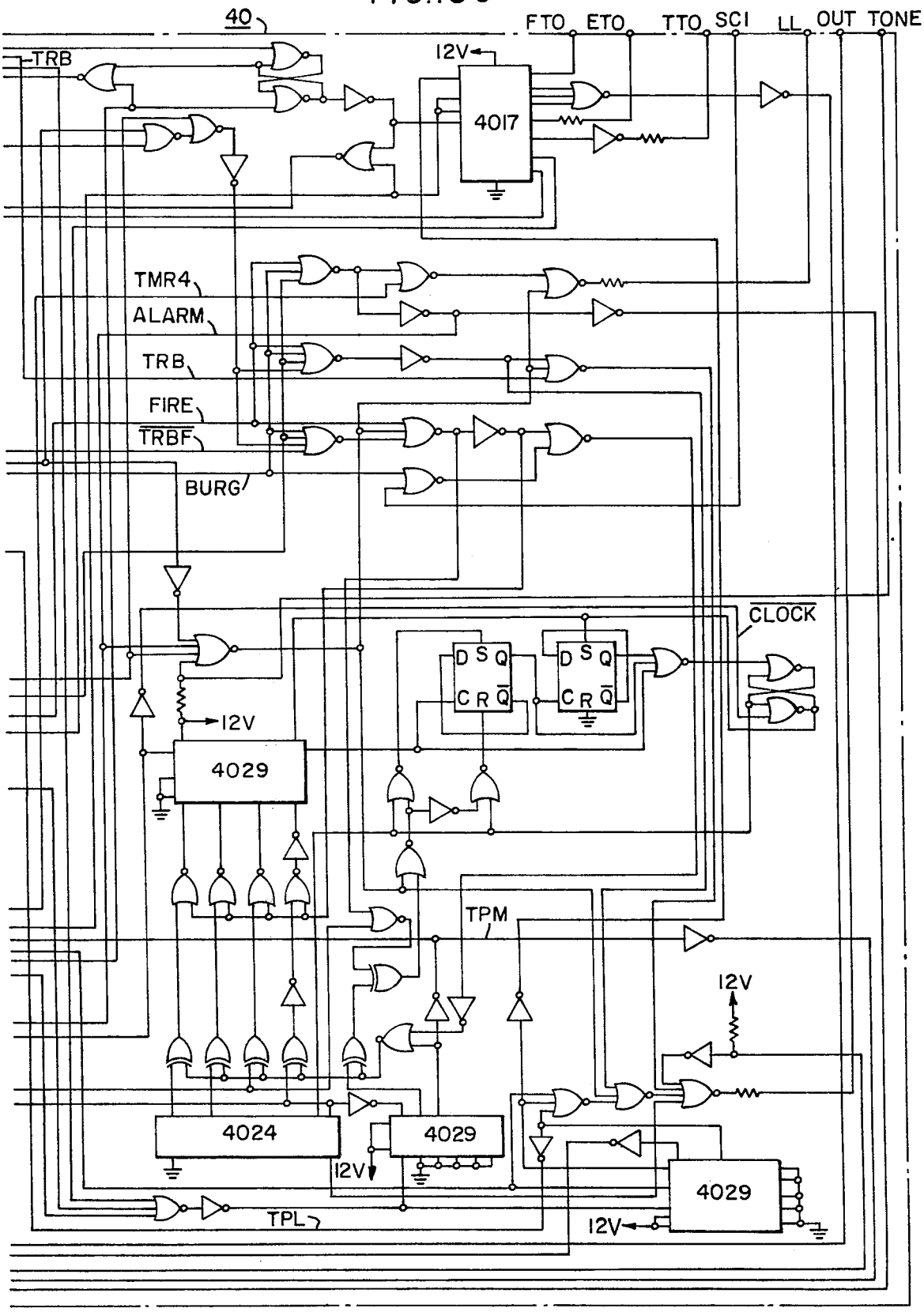

In particular, the advantages of using the type of oscillator illustrated schematically in FIG. 14A are:

1. It uses only one pin on the chip schematically illustrated in FIG. 18;
2. It may be used with a capacitor as an oscillator;
3. It may be driven by an external oscillator; and
4. When used with a capacitor it has a stable frequency versus power supply characteristic.

The Clock Oscillator Circuit K of FIG. 14 provides the fundamental clock signal of 97.28 KHz which is supplied as an input to the Noise Generator and System Timing Circuit J. The Noise Generator and System Timing Circuit J generates all system timing signals as well as signal FO.

The large-scale integrated circuit comprising the one-chip primary electronics 40 is illustrated in the integrated circuit layout of FIGS. 18A, B and C. The chip represented by the large-scale integrated circuit layout of FIGS. 18A, B and C measures approximately 150 mils by 100 mils and incorporates the circuit components and functions illustrated in block diagram form in FIG. 3 and schematically illustrated in detail in FIGS. 4–14.

The large-scale integrated circuit is fabricated in low threshold ion implant PMOS.

APPENDIX A
FIRE ALARM

| TIME - MILLISECONDS | FREQUENCY - KILOHERTZ |
|---|---|
| 0 | .868571 |
| 4.60526 | .868571 |
| 9.21053 | .868571 |
| 13.8158 | .868571 |
| 18.4211 | 1.216 |
| 23.0263 | 1.216 |
| 26.3158 | 1.216 |
| 29.6053 | 1.216 |
| 32.8947 | .868571 |
| 36.1842 | .868571 |
| 40.7895 | .868571 |
| 45.3947 | .868571 |
| 50. | 1.216 |
| 54.6053 | 1.216 |
| 57.8947 | 1.216 |
| 61.1842 | 1.216 |
| 64.4737 | 1.216 |
| 67.7632 | 1.216 |
| 71.0526 | 1.216 |
| 74.3421 | 1.216 |
| 77.6316 | .868571 |
| 80.9211 | .868571 |
| 85.5263 | .868571 |
| 90.1316 | .868571 |
| 94.7368 | 1.216 |
| 99.3421 | 1.216 |
| 102.632 | 1.216 |
| 105.921 | 1.216 |
| 109.211 | .868571 |
| 112.5 | .868571 |
| 117.105 | .868571 |
| 121.711 | .868571 |
| 126.316 | .868571 |
| 130.921 | .868571 |
| 135.526 | .868571 |
| 140.132 | .868571 |
| 144.737 | 1.216 |
| 149.342 | 1.216 |
| 152.632 | 1.216 |
| 155.921 | 1.216 |
| 159.211 | .868571 |

-continued

APPENDIX A
FIRE ALARM

| TIME - MILLISECONDS | FREQUENCY - KILOHERTZ |
|---|---|
| 162.5 | .868571 |
| 167.105 | .868571 |
| 171.711 | .868571 |
| 176.316 | 1.216 |
| 180.921 | 1.216 |
| 184.211 | 1.216 |
| 187.5 | 1.216 |
| 190.789 | 1.216 |
| 194.079 | 1.216 |
| 197.368 | 1.216 |
| 200.658 | 1.216 |
| 203.947 | .868571 |
| 207.237 | .868571 |
| 211.842 | .868571 |
| 216.447 | .868571 |
| 221.053 | 1.216 |
| 225.658 | 1.216 |
| 228.947 | 1.216 |
| 232.237 | 1.216 |
| 235.526 | .868571 |
| 238.816 | .868571 |
| 243.421 | .868571 |
| 248.026 | .868571 |
| 252.632 | .868571 |
| 257.237 | .868571 |
| 261.842 | .868571 |
| 266.447 | .868571 |
| 271.053 | 1.216 |
| 275.658 | 1.216 |
| 278.947 | 1.216 |
| 282.237 | 1.216 |
| 285.526 | .868571 |
| 288.816 | .868571 |
| 293.421 | .868571 |
| 298.026 | .868571 |
| 302.632 | 1.216 |
| 307.237 | 1.216 |
| 310.526 | 1.216 |
| 313.816 | 1.216 |
| 317.105 | 1.216 |
| 320.395 | 1.216 |
| 323.684 | 1.216 |
| 326.974 | 1.216 |
| 330.263 | .868571 |
| 333.553 | .868571 |
| 338.158 | .868571 |
| 342.763 | .868571 |
| 347.368 | 1.216 |
| 351.974 | 1.216 |
| 355.263 | 1.216 |
| 358.553 | 1.216 |
| 361.842 | .868571 |
| 365.132 | .868571 |
| 369.737 | .868571 |
| 374.342 | .868571 |
| 378.947 | .868571 |
| 383.553 | .868571 |
| 388.158 | .868571 |
| 392.763 | .868571 |
| 397.368 | 1.216 |
| 401.974 | 1.216 |
| 405.263 | 1.216 |
| 408.553 | 1.216 |
| 411.842 | .868571 |
| 415.132 | .868571 |
| 419.737 | .868571 |
| 424.342 | .868571 |
| 428.947 | 1.216 |
| 433.553 | 1.216 |
| 436.842 | 1.216 |
| 440.132 | 1.216 |
| 443.421 | 1.216 |
| 446.711 | 1.216 |
| 450. | 1.216 |
| 453.289 | 1.216 |
| 456.579 | .868571 |
| 459.868 | .868571 |
| 464.474 | .868571 |
| 469.079 | .868571 |
| 473.684 | 1.216 |
| 478.289 | 1.216 |
| 481.579 | 1.216 |
| 484.868 | 1.216 |
| 488.158 | .868571 |
| 491.447 | .868571 |
| 496.053 | .868571 |
| 500.658 | .868571 |

-continued

APPENDIX A
FIRE ALARM

| TIME - MILLISECONDS | FREQUENCY - KILOHERTZ |
|---|---|
| 505.263 | .868571 |

APPENDIX B
BURGLARY ALARM

| TIME - MILLISECONDS | FREQUENCY - KILOHERTZ |
|---|---|
| 0 | 1.01333 |
| 3.94737 | .992653 |
| 7.97697 | .9728 |
| 12.0888 | .953725 |
| 16.2829 | .935385 |
| 20.5592 | .917736 |
| 24.9178 | .900741 |
| 29.3586 | .884364 |
| 33.8816 | .868571 |
| 38.4868 | .853333 |
| 43.1743 | .838621 |
| 47.9441 | .824407 |
| 52.7961 | .810667 |
| 57.7303 | .797377 |
| 62.7467 | .784516 |
| 67.8454 | .772063 |
| 73.0263 | 1.52 |
| 75.6579 | 1.47394 |
| 78.3717 | 1.43059 |
| 81.1678 | 1.38971 |
| 84.0461 | 1.35111 |
| 87.0066 | 1.31459 |
| 90.0493 | 1.28 |
| 93.1743 | 1.24718 |
| 96.3816 | 1.216 |
| 99.6711 | 1.18634 |
| 103.043 | 1.1581 |
| 106.497 | 1.13116 |
| 110.033 | 1.10545 |
| 113.651 | 1.08089 |
| 117.352 | 1.05739 |
| 121.135 | 1.03489 |
| 125. | 1.01333 |
| 128.947 | .992653 |
| 132.977 | .9728 |
| 137.089 | .953725 |
| 141.283 | .935385 |
| 145.559 | .917736 |
| 149.918 | .900741 |
| 154.359 | .884364 |
| 158.882 | .868571 |
| 163.487 | .853333 |
| 168.174 | .838621 |
| 172.944 | .824407 |
| 177.796 | .810667 |
| 182.73 | .797377 |
| 187.747 | .784516 |
| 192.845 | .772063 |
| 198.026 | 1.52 |
| 200.658 | 1.47394 |
| 203.372 | 1.43059 |
| 206.168 | 1.38971 |
| 209.046 | 1.35111 |
| 212.007 | 1.31459 |
| 215.049 | 1.28 |
| 218.174 | 1.24718 |
| 221.382 | 1.216 |
| 224.671 | 1.18634 |
| 228.043 | 1.1581 |
| 231.497 | 1.13116 |
| 235.033 | 1.10545 |
| 238.651 | 1.08089 |
| 242.352 | 1.05739 |
| 246.135 | 1.03489 |
| 250. | 1.03489 |
| 253.865 | 1.05739 |
| 257.648 | 1.08089 |
| 261.349 | 1.10545 |
| 264.967 | 1.13116 |
| 268.503 | 1.1581 |
| 271.957 | 1.18634 |
| 275.329 | 1.216 |
| 278.618 | 1.24718 |
| 281.826 | 1.28 |
| 284.951 | 1.31459 |
| 287.993 | 1.35111 |
| 290.954 | 1.38971 |
| 293.832 | 1.43059 |
| 296.628 | 1.47394 |

-continued

APPENDIX B
BURGLARY ALARM

| TIME - MILLISECONDS | FREQUENCY - KILOHERTZ |
|---|---|
| 299.342 | 1.52 |
| 301.974 | .772063 |
| 307.155 | .784516 |
| 312.253 | .797377 |
| 317.27 | .810667 |
| 322.204 | .824407 |
| 327.056 | .838621 |
| 331.826 | .853333 |
| 336.513 | .868571 |
| 341.118 | .884364 |
| 345.641 | .900741 |
| 350.082 | .917736 |
| 354.441 | .935385 |
| 358.717 | .953725 |
| 362.911 | .9728 |
| 367.023 | .992653 |
| 371.053 | 1.01333 |
| 375. | 1.03489 |
| 378.865 | 1.05739 |
| 382.648 | 1.08089 |
| 386.349 | 1.10545 |
| 389.967 | 1.13116 |
| 393.503 | 1.1581 |
| 396.957 | 1.18634 |
| 400.329 | 1.216 |
| 403.618 | 1.24718 |
| 406.826 | 1.28 |
| 409.951 | 1.31459 |
| 412.993 | 1.35111 |
| 415.954 | 1.38971 |
| 418.832 | 1.43059 |
| 421.628 | 1.47394 |
| 424.342 | 1.52 |
| 426.974 | .772063 |
| 432.155 | .784516 |
| 437.253 | .797377 |
| 442.27 | .810667 |
| 447.204 | .824407 |
| 452.056 | .838621 |
| 456.826 | .853333 |
| 461.513 | .868571 |
| 466.118 | .884364 |
| 470.641 | .900741 |
| 475.082 | .917736 |
| 479.441 | .935385 |
| 483.717 | .953725 |
| 487.911 | .9728 |
| 492.023 | .992653 |
| 496.053 | 1.01333 |
| 500. | 1.01333 |

APPENDIX C
EMERGENCY ALARM

| TIME - MILLISECONDS | FREQUENCY - KILOHERTZ |
|---|---|
| 0 | 1.03489 |
| 3.86513 | 1.05739 |
| 7.64803 | 1.08089 |
| 11.3487 | 1.10545 |
| 14.9671 | 1.13116 |
| 18.5033 | 1.1581 |
| 21.9572 | 1.18634 |
| 25.3289 | 1.216 |
| 28.6184 | 1.24718 |
| 31.8257 | 1.28 |
| 34.9507 | 1.31459 |
| 37.9934 | 1.35111 |
| 40.9539 | 1.38971 |
| 43.8322 | 1.43059 |
| 46.6283 | 1.47394 |
| 49.3421 | 1.52 |
| 51.9737 | .772063 |
| 57.1546 | .784516 |
| 62.2533 | .797377 |
| 67.2697 | .810667 |
| 72.2039 | .824407 |
| 77.0559 | .838621 |
| 81.8257 | .853333 |
| 86.5132 | .868571 |
| 91.1184 | .884364 |
| 95.6414 | .900741 |
| 100.082 | .917736 |
| 104.441 | .935385 |
| 108.717 | .953725 |
| 112.911 | .9728 |

-continued

APPENDIX C
EMERGENCY ALARM

| TIME - MILLISECONDS | FREQUENCY - KILOHERTZ |
|---|---|
| 117.023 | .992653 |
| 121.053 | 1.01333 |
| 125. | 1.03489 |
| 128.865 | 1.05739 |
| 132.648 | 1.08089 |
| 136.349 | 1.10545 |
| 139.967 | 1.13116 |
| 143.503 | 1.1581 |
| 146.957 | 1.18634 |
| 150.329 | 1.216 |
| 153.618 | 1.24718 |
| 156.826 | 1.28 |
| 159.951 | 1.31459 |
| 162.993 | 1.35111 |
| 165.954 | 1.38971 |
| 168.832 | 1.43059 |
| 171.628 | 1.47394 |
| 174.342 | 1.52 |
| 176.974 | .772063 |
| 182.155 | .784516 |
| 187.253 | .797377 |
| 192.27 | .810667 |
| 197.204 | .824407 |
| 202.056 | .838621 |
| 206.826 | .853333 |
| 211.513 | .868571 |
| 216.118 | .884364 |
| 220.641 | .900741 |
| 225.082 | .917736 |
| 229.441 | .935385 |
| 233.717 | .953725 |
| 237.911 | .9728 |
| 242.023 | .992653 |
| 246.053 | 1.01333 |
| 250. | 1.03489 |
| 253.865 | 1.05739 |
| 257.648 | 1.08089 |
| 261.349 | 1.10545 |
| 264.967 | 1.13116 |
| 268.503 | 1.1581 |
| 271.957 | 1.18634 |
| 275.329 | 1.216 |
| 278.618 | 1.24718 |
| 281.826 | 1.28 |
| 284.951 | 1.31459 |
| 287.993 | 1.35111 |
| 290.954 | 1.38971 |
| 293.832 | 1.43059 |
| 296.628 | 1.47394 |
| 299.342 | 1.52 |
| 301.974 | .772063 |
| 307.155 | .784516 |
| 312.253 | .797377 |
| 317.27 | .810667 |
| 322.204 | .824407 |
| 327.056 | .838621 |
| 331.826 | .853333 |
| 336.513 | .868571 |
| 341.118 | .884364 |
| 345.641 | .900741 |
| 350.082 | .917736 |
| 354.441 | .935385 |
| 358.717 | .953725 |
| 362.911 | .9728 |
| 367.023 | .992653 |
| 371.053 | 1.01333 |
| 375. | 1.03489 |
| 378.865 | 1.05739 |
| 382.648 | 1.08089 |
| 386.349 | 1.10545 |
| 389.967 | 1.13116 |
| 393.503 | 1.1581 |
| 396.957 | 1.18634 |
| 400.329 | 1.216 |
| 403.618 | 1.24718 |
| 406.826 | 1.28 |
| 409.951 | 1.31459 |
| 412.993 | 1.35111 |
| 415.954 | 1.38971 |
| 418.832 | 1.43059 |
| 421.628 | 1.47394 |
| 424.342 | 1.52 |
| 426.974 | .772063 |
| 432.155 | .784516 |
| 437.253 | .797377 |
| 442.27 | .810667 |
| 447.204 | .824407 |
| 452.056 | .838621 |
| 456.826 | .853333 |

-continued

APPENDIX C
EMERGENCY ALARM

| TIME - MILLISECONDS | FREQUENCY - KILOHERTZ |
|---|---|
| 461.513 | .868571 |
| 466.118 | .884364 |
| 470.641 | .900741 |
| 475.082 | .917736 |
| 479.441 | .935385 |
| 483.717 | .953725 |
| 487.911 | .9728 |
| 492.023 | .992653 |
| 496.053 | 1.01333 |
| 500. | 1.01333 |

We claim:

1. A solid state security system comprising, at least one remote intrusion sensor circuit for producing intrusion alarm output signals in response to intrusion alarm conditions, at least one remote fire sensor circuit for producing fire alarm output signals in response to fire alarm conditions, a remote monitoring center, a local security console operatively coupling said remote fire sensor circuit and said remote intrusion sensor circuit to said remote monitoring center, said local security console including:

microphone means for providing verbal communication between said local security console and said remote monitoring center, input circuit means operatively connected to said remote fire sensor circuit and said remote intrusion sensor circuit and responding to a fire alarm output signal by developing a first digitally modulated, frequency modulated digital audio waveform indicative of a fire alarm condition and responding to an intrusion alarm output signal by developing a second digitally modulated, frequency modulated digital audio output waveform indicative of an intrusion alarm condition, and control circuit means operatively connected between said input circuit means and said microphone means for enabling said microphone means in the absence of alarm conditions, disabling said microphone means during a fire alarm condition and enabling said microphone means after the expiration of a predetermined time period following the occurrence of an intrusion alarm condition.

2. A solid state security system as claimed in claim 1 further including a telephone communications channel connected between said primary electronics and said remote monitoring center, wherein a digital output signal of said primary electronics indicative of a particular alarm condition initiates a telephone transmission of predetermined information representative of said alarm condition to said remote monitoring center.

3. A solid state security system as claimed in claim 1 wherein said local security console further includes, a digital noise generator circuit means driven by a digital pulse wave excitation circuit operatively connected to said input circuit means and said control circuit means to produce a first digitally modulated frequency modulated digital audio output waveform in response to a first digital output signal and a second digitally modulated frequency modulated digital audio output waveform in response to a second digital output signal and speaker means for manifesting said digital audio output waveforms.

4. A solid state security system as claimed in claim 3 wherein said control circuit means functions to transmit the digitally modulated, frequency modulated digital audio output waveform indicative of an intrusion alarm condition to said speaker means and terminate the digital audio output waveform indicative of an intrusion alarm condition during a predetermined time interval to permit verbal communication between said local security console and said remote monitoring center.

5. A solid state security system as claimed in claim 1 wherein said local security console further includes an emergency actuator means operatively connected to said input circuit means and said control circuit means, said input circuit means responding to an actuation of said emergency actuator means by developing a digital output signal indicative thereof, said control circuit means enabling said microphone means in response to an actuation of said emergency actuator means.

6. A solid state security system as claimed in claim 1 wherein said local security console includes an alarm acknowledge light, and circuit means operatively connected between said local security console and said remote monitoring center to activate said alarm acknowledge light in response to a signal transmitted from said remote monitoring center.

* * * * *